US011585007B2

(12) United States Patent
Banik, II et al.

(10) Patent No.: US 11,585,007 B2
(45) Date of Patent: Feb. 21, 2023

(54) CROSS FLOW CONDUIT FOR FOAMING PREVENTION IN HIGH CONVECTION PLATING CELLS

(71) Applicant: Lam Research Corporation, Fremont, CA (US)

(72) Inventors: Stephen J. Banik, II, Philadelphia, PA (US); Aaron Berke, Portland, OR (US); Gabriel Hay Graham, Portland, OR (US); Gregory J. Kearns, West Linn, OR (US); Lee Peng Chua, Beaverton, OR (US); Bryan L. Buckalew, Tualatin, OR (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 17/309,214

(22) PCT Filed: Nov. 15, 2019

(86) PCT No.: PCT/US2019/061853
§ 371 (c)(1),
(2) Date: May 7, 2021

(87) PCT Pub. No.: WO2020/106590
PCT Pub. Date: May 28, 2020

(65) Prior Publication Data

US 2021/0395913 A1 Dec. 23, 2021

Related U.S. Application Data

(60) Provisional application No. 62/769,184, filed on Nov. 19, 2018.

(51) Int. Cl.
*C25D 5/08* (2006.01)
*C25D 7/12* (2006.01)
(Continued)

(52) U.S. Cl.
CPC ..... *C25D 17/001* (2013.01); *C25D 5/08* (2013.01); *C25D 7/123* (2013.01); *C25D 17/008* (2013.01); *C25D 21/12* (2013.01)

(58) Field of Classification Search
CPC ..... C25D 7/12–123; H01L 21/2885; H01L 21/76873
See application file for complete search history.

(56) References Cited

U.S. PATENT DOCUMENTS 1,255,395 A 2/1918 Duram
2,432,973 A 12/1947 Smedberg
(Continued)

FOREIGN PATENT DOCUMENTS

JP H2-122098 A 5/1990
JP H4-056799 A 2/1992
(Continued)

OTHER PUBLICATIONS

International Search Report and Written Opinion dated Mar. 10, 2020, in PCT Application No. PCT/US2019/061853.
(Continued)

*Primary Examiner* — Ho-Sung Chung
(74) *Attorney, Agent, or Firm* — Weaver Austin Villeneuve & Sampson LLP

(57) ABSTRACT

The embodiments herein relate to apparatuses and methods for electroplating one or more materials onto a substrate. Embodiments herein utilize a cross flow conduit in the electroplating cell to divert flow of fluid from a region between a substrate and a channeled ionically resistive plate positioned near the substrate down to a level lower than level of fluid in a fluid containment unit for collecting overflow fluid from the plating system for recirculation. The cross flow conduit can include channels cut into components of the plating cell to allow diverted flow, or can include an
(Continued)

attachable diversion device mountable to an existing plating cell to divert flow downwards to the fluid containment unit. Embodiments also include a flow restrictor which may be a plate or a pressure relief valve for modulating flow of fluid in the cross flow conduit during plating.

7 Claims, 16 Drawing Sheets

(51) Int. Cl.
*C25D 21/12* (2006.01)
*C25D 17/00* (2006.01)

(56) References Cited

U.S. PATENT DOCUMENTS

| | | | | |
|---|---|---|---|---|
| 6,391,209 | B1 | 5/2002 | Belongia et al. | |
| 6,527,920 | B1 | 3/2003 | Mayer et al. | |
| 6,551,487 | B1 | 4/2003 | Reid et al. | |
| 6,582,580 | B1 * | 6/2003 | Hongo | H01L 21/6723 427/430.1 |
| 6,773,571 | B1 | 8/2004 | Mayer et al. | |
| 6,800,187 | B1 | 10/2004 | Reid et al. | |
| 6,821,407 | B1 | 11/2004 | Reid et al. | |
| 8,262,871 | B1 | 9/2012 | Mayer et al. | |
| 8,308,931 | B2 | 11/2012 | Reid et al. | |
| 9,567,685 | B2 | 2/2017 | Kagajwala et al. | |
| 9,617,652 | B2 | 4/2017 | Abraham et al. | |
| 10,208,395 | B2 | 2/2019 | Abraham et al. | |
| 11,001,934 | B2 | 5/2021 | Banik, II et al. | |
| 2002/0027080 | A1 | 3/2002 | Yoshioka et al. | |
| 2002/0195352 | A1 | 12/2002 | Mayer et al. | |
| 2003/0217929 | A1 | 11/2003 | Peace | |
| 2004/0025248 | A1 | 2/2004 | Lang et al. | |
| 2005/0082163 | A1 | 4/2005 | Yoshioka et al. | |
| 2010/0032310 | A1 | 2/2010 | Reid et al. | |
| 2011/0083965 | A1 | 4/2011 | Reid et al. | |
| 2014/0166476 | A1 * | 6/2014 | Abraham | C25D 5/08 204/237 |
| 2016/0265132 | A1 | 9/2016 | Graham et al. | |
| 2017/0058417 | A1 * | 3/2017 | Graham | C25D 17/001 |
| 2017/0167045 | A1 | 6/2017 | Abraham et al. | |
| 2017/0342590 | A1 | 11/2017 | Thorkelsson et al. | |
| 2022/0307152 | A1 | 9/2022 | Richardson et al. | |

FOREIGN PATENT DOCUMENTS

| | | | |
|---|---|---|---|
| JP | 2004-250785 | | 9/2004 |
| JP | 2008-527173 | A | 7/2008 |
| JP | 4575401 | B2 | 11/2010 |
| JP | 4957906 | B2 | 6/2012 |
| KR | 2001-0090469 | A | 10/2001 |
| KR | 20020032782 | A | 5/2002 |
| KR | 2010-0047161 | A | 5/2010 |
| TW | I281516 | B | 5/2007 |
| WO | WO 2001/068952 | A1 | 9/2001 |
| WO | WO 2006/074106 | A2 | 7/2006 |

OTHER PUBLICATIONS

U.S. Office Action dated Dec. 16, 2015 issued in U.S. Appl. No. 14/102,220.
U.S. Final Office Action dated Aug. 26, 2016 issued in U.S. Appl. No. 14/102,220.
U.S. Notice of Allowance dated Dec. 7, 2016 issued in U.S. Appl. No. 14/102,220.
U.S. Office Action dated Jan. 26, 2018 issued in U.S. Appl. No. 15/442,519.
U.S. Notice of Allowance dated Oct. 10, 2018 issued in U.S. Appl. No. 15/442,519.
Japanese First Office Action dated Feb. 20, 2018 issued in Application No. JP 2013-255654.
Japanese First Office Action dated Sep. 5, 2019 issued in Application No. JP 2018-174852.
Korean Decision For Grant of Patent dated Oct. 16, 2020 issued in Application No. KR 10-2013-0154296.
Korean First Office Action dated Feb. 16, 2021 issued in Application No. KR 10-2021-0006037.
Malaysian First Office Action dated Dec. 2, 2019 issued in Application No. MY PI2013004463.
Taiwanese First Office Action dated Apr. 26, 2017 issued in Application No. TW 102145643.
Taiwanese First Office Action dated Jun. 25, 2018 issued in Application No. TW 106132517.
International Preliminary Report on Patentability dated Jun. 3, 2021 issued in Application No. PCT/US2019/061853.
Korean First Office Action dated May 19, 2020 issued in Application No. KR 10-2013-0154296.
Malaysian Second Office Action dated Aug. 24, 2021 issued in Application No. MY PI2013004463.
International Preliminary Report on Patentability dated Jan. 6, 2022 in PCT Application No. PCT/US2020/039083.
International Search Report and Written Opinion dated Oct. 13, 2020, issued in Application No. PCT/US2020/039083.
U.S. Appl. No. 17/596,929, filed Dec. 21, 2021.

* cited by examiner

CROSS FLOW CONDUIT FOR FOAMING PREVENTION IN HIGH CONVECTION PLATING CELLS

INCORPORATION BY REFERENCE

A PCT Request Form is filed concurrently with this specification as part of the present application. Each application that the present application claims benefit of or priority to as identified in the concurrently filed PCT Request Form is incorporated by reference herein in their entireties and for all purposes.

BACKGROUND

Electrochemical deposition processes are well-established in modern integrated circuit fabrication. The transition from aluminum to copper metal line interconnections in the early years of the twenty-first century drove a need for increasingly sophisticated electrodeposition processes and plating tools. Much of the sophistication evolved in response to the need for ever smaller current carrying lines in device metallization layers. These copper lines are formed by electroplating the metal into very thin, high-aspect ratio trenches and vias in a methodology commonly referred to as "damascene" processing (pre-passivation metallization).

Electrochemical deposition is now used for sophisticated packaging and multichip interconnection technologies known generally and colloquially as wafer level packaging (WLP) and through silicon via (TSV) electrical connection technology. These technologies present their own very significant challenges due in part to the generally larger feature sizes (compared to Front End of Line (FEOL) interconnects) and high aspect ratios.

The technologies involve electroplating on a significantly larger size scale than damascene applications. Depending on the type and application of the packaging features (e.g., through chip connecting TSV, interconnection redistribution wiring, or chip to board or chip bonding, such as flip-chip pillars), plated features are usually, in current technology, greater than about 2 micrometers and typically 5-300 micrometers (for example, pillars may be about 50 micrometers). For some on-chip structures such as power busses, the feature to be plated may be larger than 300 micrometers. The aspect ratios of the WLP features are typically about 1:1 (height to width) or lower, while TSV structures can have very high aspect ratios (e.g., in the neighborhood of about 20:1).

SUMMARY

Apparatuses for controlling electrolyte hydrodynamics during electroplating are provided. One aspect involves an electroplating apparatus including: an electroplating cell configured to contain an electrolyte and an anode while electroplating metal onto a substrate, the electroplating cell having a chamber wall of a fluid containment unit having a fluid level during electroplating; a substrate holder configured to hold the substrate such that a plating face of the substrate is separated from the anode during electroplating; a channeled ionically resistive plate including a substrate-facing surface that is separated from the plating face of the substrate by a cross flow region; a cross flow inlet to the cross flow region for receiving electrolyte flowing in the cross flow region; and a cross flow conduit comprising a channel for diverting electrolyte from the cross flow region to an outlet to the fluid containment unit of the electroplating cell, the outlet being lower than the fluid level and the cross flow region being between the cross flow inlet and cross flow conduit.

In various embodiments, the cross flow region is defined at least in part by an upper surface of the channeled ionically resistive plate and a lower surface of the substrate in the substrate holder when in operation, and an insert.

In various embodiments, the cross flow conduit is disposed to accept electrolyte flowing out of the cross flow region and direct the electrolyte flowing out downward and away from a surface of the substrate.

In various embodiments, the apparatus further includes a flow restrictor for restricting flow of electrolyte in the cross flow conduit. In some embodiments, the flow restrictor is a plate inserted under the channeled ionically resistive plate. In some embodiments, the flow restrictor is a motor-driven variable aperture plate capable of varying opening size of the cross flow conduit. In some embodiments, the flow restrictor is a pressure relief valve sealing flow of electrolyte depending on pressure of the electrolyte in response to whether a substrate is present in the electroplating cell.

In various embodiments, the cross flow conduit is an attachable diversion device capable of being attached to the electroplating cell.

In various embodiments, the apparatus also includes a membrane frame below the channeled ionically resistive plate, wherein the cross flow conduit further comprises a second channel in the membrane frame for flowing electrolyte from the cross flow region to an outlet to the fluid containment unit of the electroplating cell.

In various embodiments, the apparatus also includes a weir wall. The apparatus may also include an insert adjacent to the substrate holder, the insert including the weir wall for containing electrolyte to a fluid level over the insert during electroplating to ensure complete wetting of the substrate upon entry. In some embodiments, the weir wall includes a base disposed above the insert.

In some embodiments, the weir wall is not a part of the channeled ionically resistive plate.

In some embodiments, during operation, the cross flow conduit prevents electrolyte from flowing over the weir wall.

In various embodiments, the cross flow conduit is disposed on a portion of the channeled ionically resistive plate proximate to an exit of the cross flow region.

In various embodiments where the apparatus also includes a membrane frame, the cross flow conduit is additionally disposed on a portion of the membrane frame.

In various embodiments, the cross flow conduit is additionally disposed on a portion of the chamber wall.

In various embodiments, the cross flow conduit is disposed in a detachable member.

In some embodiments, the apparatus may also include a controller comprising executable instructions for electroplating material onto the substrate by: causing flow of electrolyte via cross flow across a surface of the substrate from one side of the substrate to the opposite side of the substrate; causing diversion of flow of electrolyte to below fluid level as electrolyte flows to the opposite side of the substrate for collection in fluid containment unit; and causing widening and narrowing of an opening of the cross flow conduit using the motor-driven variable aperture plate in response to flow rate of electrolyte.

Another aspect may involve a method for electroplating on a substrate, the method including: receiving a substrate in a substrate holder, where the substrate holder is configured to hold the substrate such that a plating face of the substrate is separated from an anode during electroplating; immersing the substrate in electrolyte, where a cross flow region is formed between the plating face of the substrate and an upper surface of a channeled ionically resistive plate; flowing electrolyte in contact with the substrate in the substrate holder from below the channeled ionically resistive plate, across the channeled ionically resistive plate through the cross flow region, into the cross flow region, and out a cross flow conduit; modulating an opening of the cross flow conduit using a flow restrictor; and electroplating material onto the plating face of the substrate while flowing electrolyte and while modulating the opening of the cross flow conduit.

In various embodiments, the cross flow region is defined at least in part by an upper surface of the channeled ionically resistive plate and a lower surface of the substrate in the substrate holder when in operation, and an insert.

In various embodiments, the cross flow conduit is disposed to accept electrolyte flowing out of the cross flow region and direct the electrolyte flowing out downward and away from a surface of the substrate.

In various embodiments, the flow restrictor restricts flow of electrolyte in the cross flow conduit. In some embodiments, the flow restrictor is a plate inserted under the channeled ionically resistive plate. In some embodiments, the flow restrictor is a motor-driven variable aperture plate capable of varying opening size of the cross flow conduit. In some embodiments, the flow restrictor is a pressure relief valve sealing flow of electrolyte depending on pressure of the electrolyte in response to whether a substrate is present in the electroplating cell.

In various embodiments, the cross flow conduit is an attachable diversion device capable of being attached to the electroplating cell.

In various embodiments, the method also includes flowing electrolyte from the cross flow region to an outlet to the fluid containment unit of the electroplating cell using a second channel in a membrane frame disposed below the channeled ionically resistive plate.

In various embodiments, the substrate is completely wetted upon entry. the method is performed using a plating cell having a weir wall. The plating cell may also include an insert adjacent to the substrate holder, the insert including the weir wall for containing electrolyte to a fluid level over the insert during electroplating to ensure complete wetting of the substrate upon entry. In some embodiments, the weir wall includes a base disposed above the insert. In some embodiments, the weir wall is not a part of the channeled ionically resistive plate.

In some embodiments, during operation, the cross flow conduit prevents electrolyte from flowing over the weir wall.

In various embodiments, the cross flow conduit is disposed on a portion of the channeled ionically resistive plate proximate to an exit of the cross flow region.

In various embodiments, the cross flow conduit is additionally disposed on a portion of the chamber wall.

In various embodiments, the cross flow conduit is disposed in a detachable member.

These and other aspects are described further below with reference to the drawings.

DETAILED DESCRIPTION

Figure 1A:
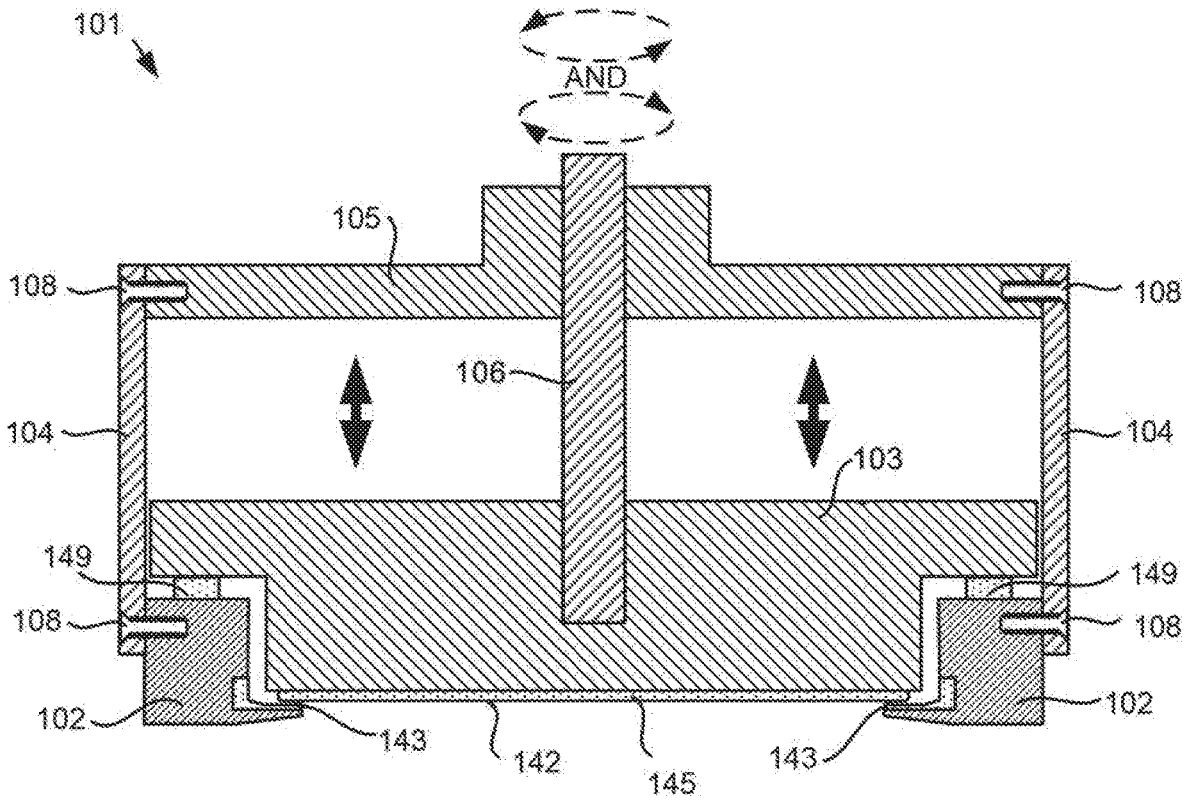
FIG. 1A depicts a cross-sectional view of a portion of a substrate holding assembly including a cone and cup.

The disclosed embodiments relate to methods and apparatus for controlling electrolyte hydrodynamics during electroplating. More particularly, methods and apparatus described herein are particularly useful for plating metals onto semiconductor wafer substrates, such as through resist plating (e.g., copper, nickel, tin and tin alloy solders), and copper through silicon via (TSV) features.

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. The following detailed description assumes the disclosed embodiments are implemented on a wafer. Oftentimes, semiconductor wafers have a diameter of 200 mm, 300 mm, or 450 mm. However, disclosed embodiments are not so limited. The work piece may be of various shapes, sizes, and materials. In addition to semiconductor wafers, other work pieces that may take advantage of disclosed embodiments include various articles such as printed circuit boards and the like.

In the following description, numerous specific details are set forth in order to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

The methods and apparatus provided herein can be used for electroplating on a variety of substrates, including WLP, TSV, and Damascene substrates. A variety of metals and metal alloys can be electroplated, including but not limited to copper, tin, silver, tin-silver alloy, nickel, gold, indium, and cobalt. In a typical electroplating process the wafer substrate containing an exposed conductive seed layer is cathodically biased and is brought in contact with an electroplating solution containing ions of a metal that is being plated. Ions are electrochemically reduced at the surface of the seed layer to form a metal layer. Various disclosed embodiments will be illustrated using through-resist electroplating as an example, but disclosed embodiments are not so limited.

Disclosed embodiments pertain to an electroplating apparatus and electroplating methods. Specifically, this disclosed embodiments pertain to improving electrolyte hydrodynamics during electroplating of metal layers on semiconductor substrates and the manner in which current and/or voltage are applied to the substrates during electroplating.

Disclosed embodiments include electroplating apparatus configured for, and methods including, control of electrolyte hydrodynamics during plating so that highly uniform plating layers are obtained. In specific implementations, the disclosed embodiments employ methods and apparatus that create shear flow (sometimes referred to as "cross flow" or flow with velocity parallel to the work piece surface).

Disclosed embodiments are suitable for filling a wide variety of features. In various embodiments, certain disclosed embodiments are suitable for filling features having a depth between about 2 and about 240 μm, or about 20 and 240 μm. Features may have a width or a diameter of the feature of about 10 μm to about 240 μm, or about 30 to 200 μm. Features may have an aspect ratio of between about 0.1:1 and about 4:1, or about 1:1.

Plating Chamber

One embodiment is an electroplating apparatus including the following features: (a) a plating chamber configured to contain an electrolyte and an anode while electroplating metal onto a substrate, the substrate being substantially planar; (b) a substrate holder configured to hold the substrate such that a plating face of the substrate is separated from the anode during electroplating; (c) a channeled ionically resistive plate (CIRP) including a substrate-facing surface that is substantially parallel to and separated from a plating face of the substrate during electroplating, the CIRP including a plurality of non-communicating channels, where the non-communicating channels allow for transport of the electrolyte through the element during electroplating; (d) a mechanism for creating and/or applying a shearing force (cross flow) to the electrolyte flowing in the cross flow region at the plating face of the substrate; (e) an optional cross flow region defined between the plating face of the substrate and the substrate-facing surface of the channeled ionically resistive element, the cross flow region having a height that can be dynamically controlled during electroplating; and (f) an optional mechanism for promoting shear flow near the periphery of the substrate, proximate a substrate/substrate holder interface. Though the wafer is substantially planar, it also typically has one or more microscopic trenches and may have one or more portions of the surface masked from electrolyte exposure. In various embodiments, the apparatus also includes a mechanism for rotating the substrate and/or the CIRP while flowing electrolyte in the electroplating cell in the direction of the substrate plating face. In certain implementations, the apparatus may include a seal or flow ring configured to prevent electrolyte from leaving the cross flow region at locations other than a designated outlet to the cross flow region positioned azimuthally opposite an inlet to the cross flow region.

In some such embodiments, a seal or flow ring may be provided between a bottom surface of the substrate holder and an upper surface of an element positioned below the substrate holder (e.g., a flow confinement element or insert, CIRP, etc.) when the substrate holder is in its lowest position. The seal may prevent electrolyte from leaking out of the apparatus between the bottom of the substrate holder and the top of the flow confinement element, for instance. In a number of embodiments, the apparatus may cycle between a sealed position (when the position of the substrate holder is at its lowest and the height of the cross flow region is at a minimum) and an unsealed position (when the substrate holder is elevated and the height of the cross flow region is relatively greater). The substrate may be rotated while the apparatus is in the unsealed position. In these or other cases, the substrate may also be rotated while the apparatus is in the sealed position. Periodic sealing of the cross flow can increase the volume and velocity of cross flowing electrolyte that passes over the surface of the substrate, thereby providing improved plating uniformity.

In certain implementations, the mechanism for applying cross flow is an inlet with, for example, appropriate flow directing and distributing means on or proximate to the periphery of the CIRP. The inlet directs cross flowing catholyte along the substrate-facing surface of the CIRP. The inlet is azimuthally asymmetric, partially following the circumference of the CIRP, and having one or more gaps, and defining a cross flow injection manifold between the CIRP and the substantially planar substrate during electroplating. Other elements are optionally provided for working in concert with the cross flow injection manifold. These may include a cross flow injection flow distribution showerhead and a cross flow confinement ring or front-side insert, which are further described below in conjunction with the figures. A cross flow confinement ring or front-side insert may be a half circle shape (180°) but in various embodiments may be full circle shape (360°).

The embodiments herein may be practiced with various substrate sizes. In some cases, the substrate has a diameter of about 200 mm, about 300 mm, or about 450 mm. Further, the embodiments herein may be practiced at a wide variety of overall flow rates. In certain implementations, the overall electrolyte flow rate is between about 1-60 L/min, greater than 20 L/min, greater than 25 L/min, between about 6-60 L/min, between about 20-55 L/min, between about 5-25 L/min, or between about 15-25 L/min. The flow rates achieved during plating may be limited by certain hardware constraints, such as the size and capacity of the pump being used. One of skill in the art would understand that the flow rates cited herein may be higher when the disclosed techniques are practiced with larger pumps.

In some embodiments, the electroplating apparatus contains separated anode and cathode chambers in which there are different electrolyte compositions, electrolyte circulation loops, and/or hydrodynamics in each of two chambers. An ionically permeable membrane may be employed to inhibit direct convective transport (movement of mass by flow) of one or more components between the chambers and maintain a desired separation between the chambers. The membrane may block bulk electrolyte flow and exclude transport of certain species such as organic additives while permitting transport of ions such as cations. In some embodiments, the membrane contains DuPont's NAFION™ or a related ionically selective polymer. In other cases, the membrane does not include an ion exchange material, and instead includes a micro-porous material. Conventionally, the electrolyte in the cathode chamber is referred to as "catholyte" and the electrolyte in the anode chamber is referred to as "anolyte." Frequently, the anolyte and catholyte have different compositions, with the anolyte containing little or no plating additives (e.g., accelerator, suppressor, and/or leveler) and the catholyte containing significant concentrations of such additives. The concentration of metal ions and acids also often differs between the two chambers. An example of an electroplating apparatus containing a separated anode chamber is described in U.S. Pat. No. 6,527,920, filed Nov. 3, 2000; U.S. Pat. No. 6,821,407, filed Aug. 27, 2002, and U.S. Pat. No. 8,262,871, filed Dec. 17, 2009 each of which is incorporated herein by reference in their entireties.

In some embodiments, the anode membrane need not include an ion exchange material. In some examples, the membrane is made from a micro-porous material such as polyethersulfone manufactured by Koch Membrane of Wilmington, Mass. This membrane type is most notably applicable for inert anode applications such as tin-silver plating and gold plating, but may also be used for soluble anode applications such as nickel plating.

In the following discussion, when referring to top and bottom features (or similar terms such as upper and lower features, etc.) or elements of the disclosed embodiments, the terms top and bottom are simply used for convenience and represent only a single frame of reference or implementation of the disclosed embodiments. Other configurations are possible, such as those in which the top and bottom components are reversed with respect to gravity and/or the top and bottom components become the left and right or right and left components.

While some aspects described herein may be employed in various types of plating apparatuses, for simplicity and clarity, most of the examples will concern wafer-face-down, "fountain" plating apparatus. In such apparatus, the work piece to plated (typically a semiconductor wafer in the examples presented herein) generally has a substantially horizontal orientation (which may in some cases vary by a few degrees from true horizontal for some part of, or during the entire plating process) and may be powered to rotate during plating, yielding a generally vertically upward electrolyte convection pattern. Integration of the impinging flow mass from the center to the edge of the wafer, as well as the inherent higher angular velocity of a rotating wafer at its edge relative to its center, creates a radially increasing sheering (wafer parallel) flow velocity. One example of a member of the fountain plating class of cells/apparatus is the Sabre® Electroplating System produced by and available from Novellus Systems, Inc. of San Jose, Calif. Additionally, fountain electroplating systems are described in, e.g., U.S. Pat. No. 6,800,187, filed Aug. 10, 2001 and U.S. Pat. No. 8,308,931, filed Nov. 7, 2008, which are incorporated herein by reference in their entireties.

The substrate to be plated is generally planar or substantially planar. As used herein, a substrate having features such as trenches, vias, photoresist patterns and the like is considered to be substantially planar. Often these features are on the microscopic scale, though this is not necessarily always the case. In many embodiments, one or more portions of the surface of the substrate may be masked from exposure to the electrolyte.

The following description of FIG. 1A provides a general non-limiting context to assist in understanding the apparatus and methods described herein. A wafer holding and positioning apparatus for electrochemically treating semiconductor wafers can include wafer engaging components (sometimes referred to herein as "clamshell" components). The actual clamshell includes a cup 102 and a cone 103 (see FIG. 1A) that enables pressure to be applied between the wafer and the seal, thereby securing the wafer in the cup.

Cup 102 is supported by struts 104, which are connected to a top plate 105. This assembly (102-105), collectively assembly 101, is driven by a motor (not shown), via a spindle 106. Motor (not shown) is attached to a mounting bracket (not shown). Spindle 106 transmits torque to a wafer 145 to allow rotation during plating. An air cylinder (not shown) within spindle 106 also provides vertical force between the cup 102 and cone 103 to create a seal between the wafer 145 and a sealing member (lipseal) 143 housed within the cup 102. For the purposes of this discussion, the assembly including components 102-109 is collectively referred to as a wafer holder. Note however, that the concept of a "wafer holder" extends generally to various combinations and sub-combinations of components that engage a wafer and allow its movement and positioning.

A tilting assembly, including a first plate that is slidably connected to a second plate (both of which are connected to a drive cylinder), is connected to a mounting bracket. The drive cylinder provides force for the first sliding (and thus the wafer holder) across the second plate. The distal end of wafer holder is moved along an arced path (not shown) which defines the contact region between the plates, and thus the proximal end of wafer holder (e.g., cup and cone assembly) is tilted upon a virtual pivot. This allows for angled entry of a wafer into a plating bath.

The entire apparatus 101 is lifted vertically either up or down to immerse the proximal end of the wafer holder into a plating solution via another actuator (not shown). This actuator (and the related lifting motion) provides one possible mechanism for controlling the height of the cross flow region between the substrate and the CIRP. Any similar mechanism that allows the wafer holder (or any portion thereof that supports the actual wafer) to move towards/away from the CIRP may be used for this purpose. The apparatus provides a two-component positioning mechanism provides both vertical movement along a trajectory perpendicular to an electrolyte and a tilting movement allowing deviation from a horizontal orientation (parallel to electrolyte surface) for the wafer (angled-wafer immersion capability). A more detailed description of the movement capabilities and associated hardware of apparatus 100 is described in U.S. patent application Ser. No. 16/101,291 filed on Aug. 10, 2018, and in US Patent Application Publication No. 2017/0342590, filed Jan. 23, 2017; and U.S. Pat. No. 6,551,487 filed May 31, 2001 and issued Apr. 22, 2003, which are herein incorporated by reference in their entireties.

Note that the apparatus is typically used with a particular plating cell having a plating chamber which houses an anode (e.g., a copper anode or a non-metal inert anode) and electrolyte. The plating cell may also include plumbing or plumbing connections for circulating electrolyte through the plating cell—and against the work piece being plated. It may also include membranes or other separators designed to maintain different electrolyte chemistries in an anode compartment and a cathode compartment. In one embodiment, one membrane is employed to define an anode chamber, which contains electrolyte that is substantially free of suppressors, accelerators, or other organic plating additives, or in another embodiment, where the inorganic plating composition of the anolyte and catholyte are substantially different. Means of transferring anolyte to the catholyte or to the main plating bath by physical means (e.g., direct pumping including values, or an overflow trough) may optionally also be supplied.

The following description provides more detail of the cup and cone assembly of the clamshell. FIG. 1A depicts a portion, 101, of assembly 100, including cone 103 and cup 102 in cross-section format. Note that this figure is not meant to be a true depiction of a cup and cone product assembly, but rather a stylized depiction for discussion purposes. Cup 102 is supported by top plate 105 via struts 104, which are attached via screws 108. Generally, cup 102 provides a support upon which wafer 145 rests. It includes an opening through which electrolyte from a plating cell can contact the wafer. Note that wafer 145 has a front side 142, which is where plating occurs. The periphery of wafer 145 rests on the cup 102. The cone 103 presses down on the back side of the wafer to hold it in place during plating.

To load a wafer 145 into portion 101, cone 103 is lifted from its depicted position via spindle 106 until cone 103 touches top plate 105. From this position, a gap is created between the cup 102 and the cone 103 into which wafer 145 can be inserted, and thus loaded into the cup 102. Then cone 103 is lowered to engage the wafer 145 against the periphery of cup 102 as depicted, and mate to a set of electrical contacts (not shown in 1A) radially beyond the lip seal 143 along the wafer's outer periphery.

Spindle 106 transmits both vertical force for causing cone 103 to engage a wafer 145 and torque for rotating assembly 101. These transmitted forces are indicated by the arrows in FIG. 1A. Note that wafer plating typically occurs while the wafer 145 is rotating (as indicated by the dashed arrows at the top of FIG. 1A).

Cup 102 has a compressible lip seal 143, which forms a fluid-tight seal when cone 103 engages wafer 145. The vertical force from the cone 132 and wafer 145 compresses lip seal 143 to form the fluid tight seal. The lip seal 143 prevents electrolyte from contacting the backside of wafer 145 (where it could introduce contaminating species such as copper or tin ions directly into silicon) and from contacting sensitive components of apparatus 101. There may also be seals located between the interface of the cup 102 and the wafer 145 which form fluid-tight seals to further protect the backside of wafer 145.

Cone 103 also includes a seal 149. As shown, seal 149 is located near the edge of cone 103 and an upper region of the cup 102 when engaged. This also protects the backside of wafer 145 from any electrolyte that might enter the clamshell from above the cup 102. Seal 149 may be affixed to the cone 103 or the cup 102, and may be a single seal or a multi-component seal.

Upon initiation of plating, cone 103 is raised above cup 102 and wafer 145 is introduced to assembly 102. When the wafer 145 is initially introduced into cup 102—typically by a robot arm—its front side, 142, rests lightly on lip seal 143. During plating the assembly 101 rotates in order to aid in achieving uniform plating. In subsequent figures, assembly 101 is depicted in a more simplistic format and in relation to components for controlling the hydrodynamics of electrolyte at the wafer plating surface 142 during plating. Thus, an overview of mass transfer and fluid shear at the work piece follows.

Figure 1B:
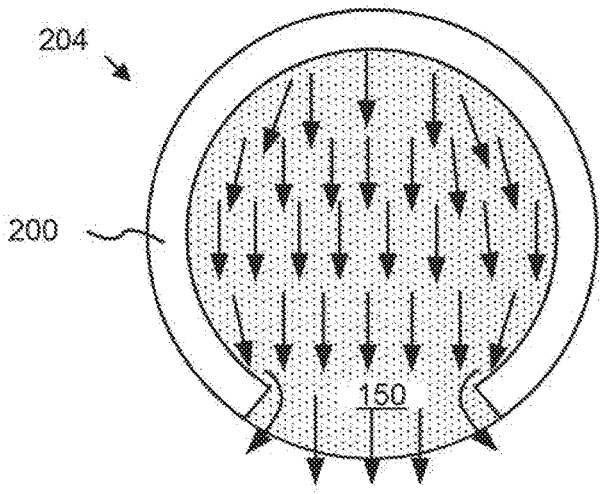
FIG. 1B illustrates an electroplating apparatus embodiment that may be used to enhance cross flow across the face of a substrate, along with top views of the flow dynamics achieved when practicing certain embodiments.

FIG. 1B relates to a technique that may be used to encourage cross flow across the face of a substrate being plated. Various techniques described in relation to these figures present alternative strategies for encouraging cross flow. As such, certain elements described in these figures are optional, and are not present in all embodiments.

In some embodiments, electrolyte flow ports are configured to aid transverse flow, alone or in combination with a flow shaping plate and a flow diverter as described herein. Various embodiments are described below in relation to a combination with a flow shaping plate and a flow diverter, but the disclosed embodiments are not so limited. Note that in certain embodiments, it is believed that the magnitude of the electrolyte flow vectors across the wafer surface are larger proximate the vent or gap and progressively smaller across the wafer surface, being smallest at the interior of the pseudo chamber furthest from the vent or gap. As depicted in FIG. 1B, by in some cases, in one example depicted in 204, an appropriately configured electrolyte flow port 200 may be used such that the magnitude of these transverse flow vectors 150 is more uniform across the wafer surface.

Figure 1C:
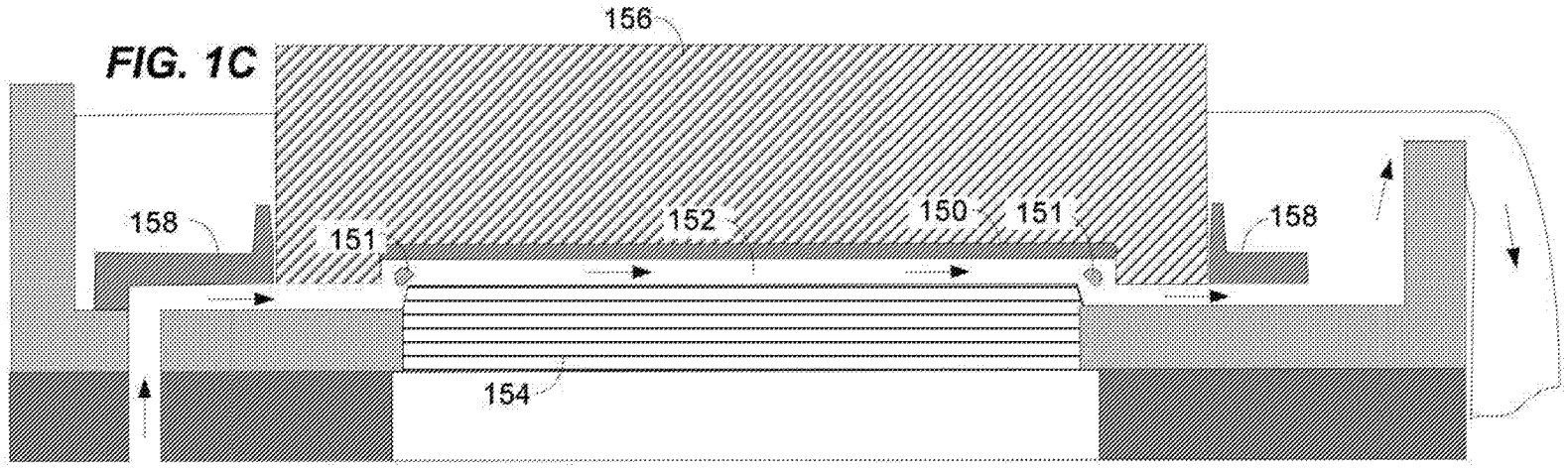
FIG. 1C illustrates a cross-sectional view of an electroplating cell where flow at the outlet goes over a weir.

FIG. 1C depicts a cross-sectional view of an electroplating cell having an edge flow element 151 installed therein. In this example, the edge flow element 151 is positioned radially outside of the raised plateau portion of the CIRP 154. The shape of the edge flow element 151 allows electrolyte near the inlet to travel upwards at an angle to reach the cross flow region 152, and similarly, allows electrolyte near the outlet to travel downwards at an angle to exit the cross flow region 152; however, flow over the weir on the right side of the illustration may cause splashing. The uppermost portion of the edge flow element 151 may extend above the plane of the raised portion of the CIRP 154. In other cases, the uppermost portion of the edge flow element 151 may be flush with the raised portion of the CIRP 154. In some cases, the position of the edge flow element 151 is adjustable, as described elsewhere herein. The shape and position of the edge flow element 151 may promote a higher degree of cross flow near the corner formed between the substrate 150 and substrate holder 156.

Figure 1E:
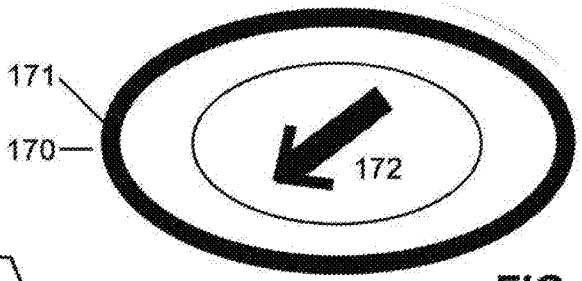
FIG. 1E shows an illustration of a CIRP having a weir wall.
Figure 1D:
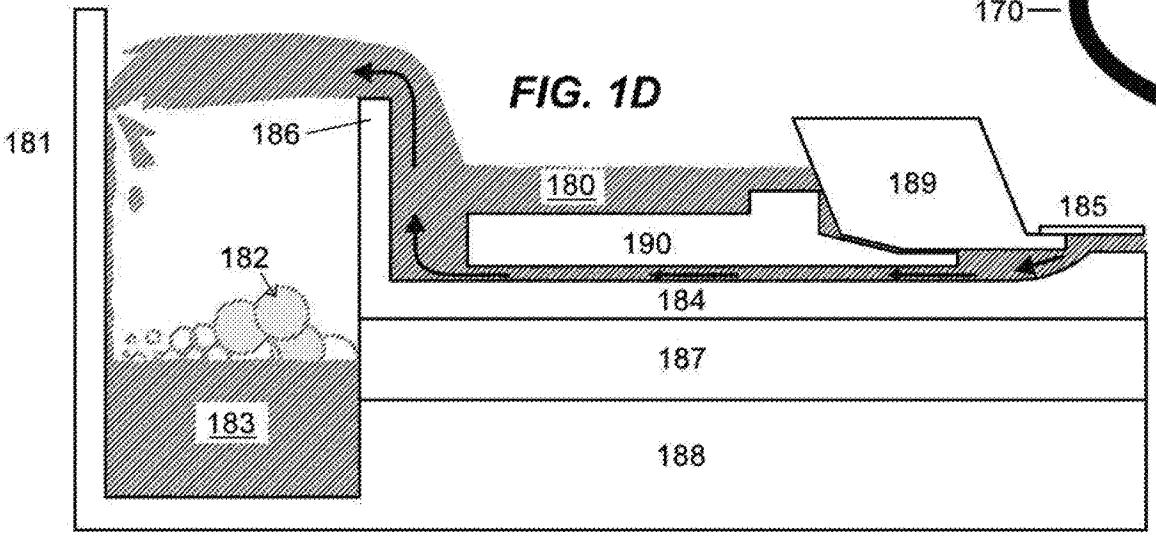
FIG. 1D shows a close-up view of a cross section of a cross flow outlet having a channeled ionically resistive plate (CIRP) weir with fluid flowing over the top of a CIRP weir.

FIG. 1D shows an illustration of the effect of the fluid 180 traveling upwards over the CIRP weir wall 186, causing entrainment of air and bubble 182 formation in the fluid containment unit that holds cell fluid containment region 183. Some plating devices deliver a high cross flow between the CIRP 184 and wafer 185, with the goal of providing fresh supply of electrolyte deep into a wafer's features. As the cross flow exits the region between the CIRP 184 and wafer 185, it flows up overtop a CIRP weir wall 186 on the CIRP 184 such as shown in FIG. 1D and then falls downward into the cell fluid containment region 183—a region of plating solution that collects before draining back into a larger bath reservoir. At low flow rates, the waterfall of fluid falling over the CIRP weir wall 186 is not sufficiently turbulent to generate foam. At high flow rates, however, the solution not only waterfalls much more turbulently, but it also jets out over the CIRP weir wall 186, impinging on the cell containment outer weir wall 181. This interaction entrains air and generates foam. In order to prevent foaming with apparatuses without a diversion device such as described herein, the plating duet fluid supply flow rate is limited to between 20 L/min and about 55 L/min, depending on the hardware configuration. In some cases, hardware may limit the flow rate to about 70-90 L/min. However, above about 20 L/min to about 55 L/min, significant foam is generated, causing the plating hardware to fault or error. Limiting the flow rate to about 20 L/min and about 55 L/min limits the metal ion supply deep within through-resist features, thereby reducing the plating throughput while also degrading on-wafer performance (e.g., silver incorporation and uniformity).

FIG. 1E shows a perspective view illustration of a CIRP 171 having a CIRP weir wall 170 which causes the fluid to move upward and over the CIRP weir wall 170, resulting in foam formation in the fluid containment unit whereby cross-flow direction is depicted by arrow 172.

Components of Plating Apparatus

Numerous figures are provided to further illustrate and explain the embodiments disclosed herein. The figures include, among other things, various drawings of the structural elements and flow paths associated with a disclosed electroplating apparatus. These elements are given certain names/reference numbers, which are used consistently in describing certain figures herein.

Figure 2:
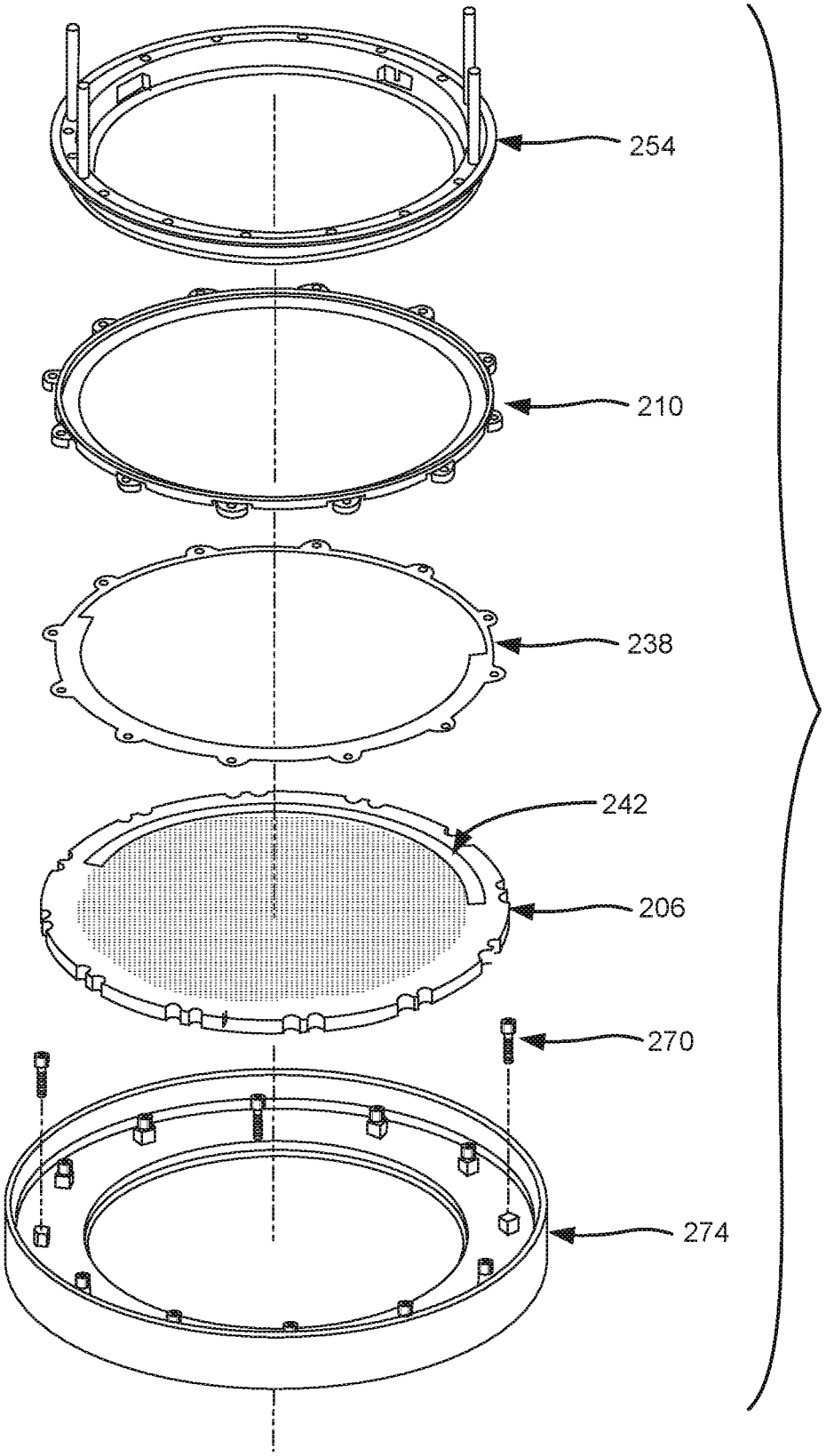
FIG. 2 illustrates an exploded view of various parts of an electroplating apparatus typically present in the cathode chamber in accordance with certain embodiments disclosed herein.
Figure 3:
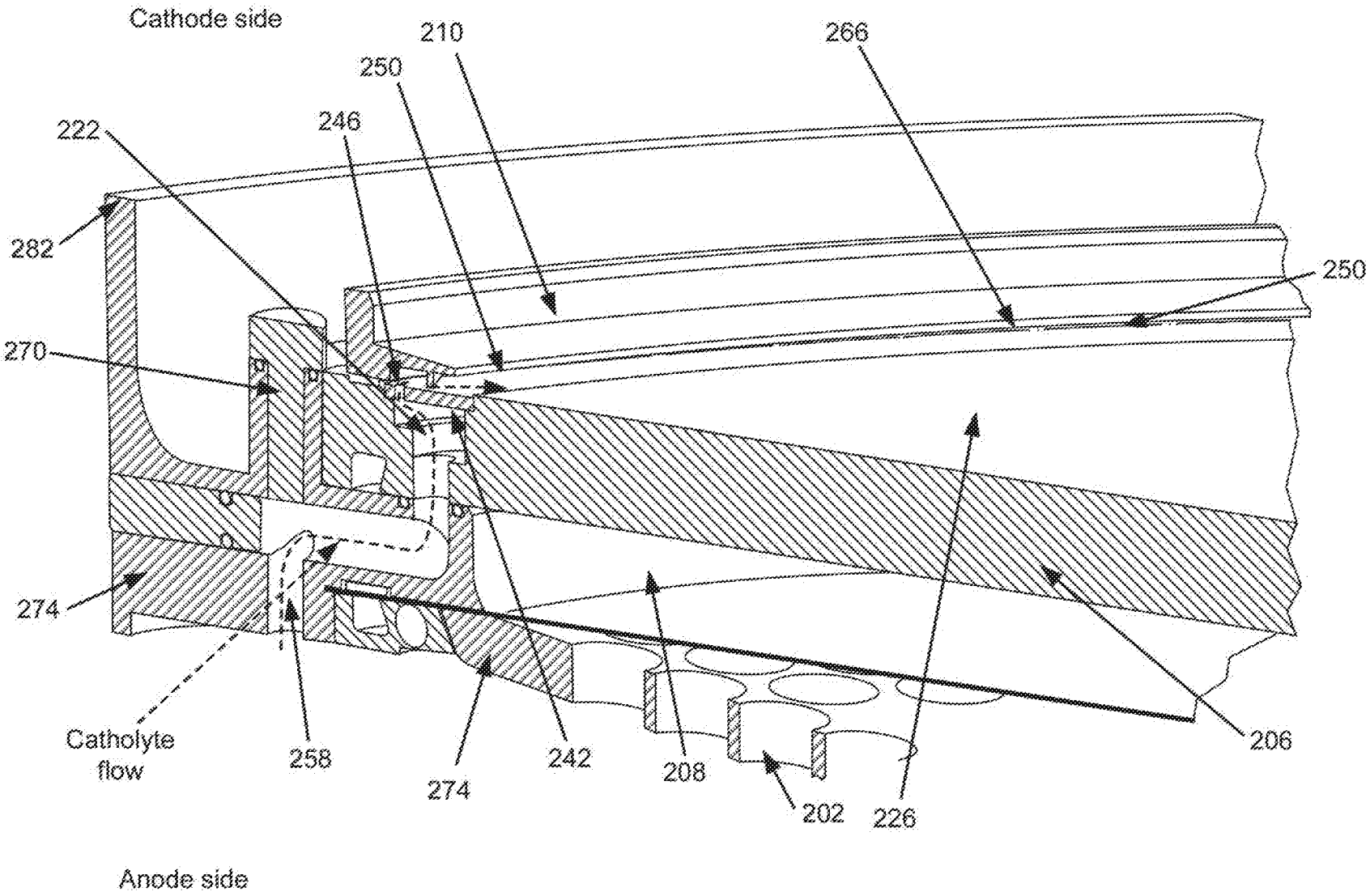
FIG. 3 shows a close-up view of a cross flow side inlet and surrounding hardware in accordance with certain embodiments herein.
Figure 4:
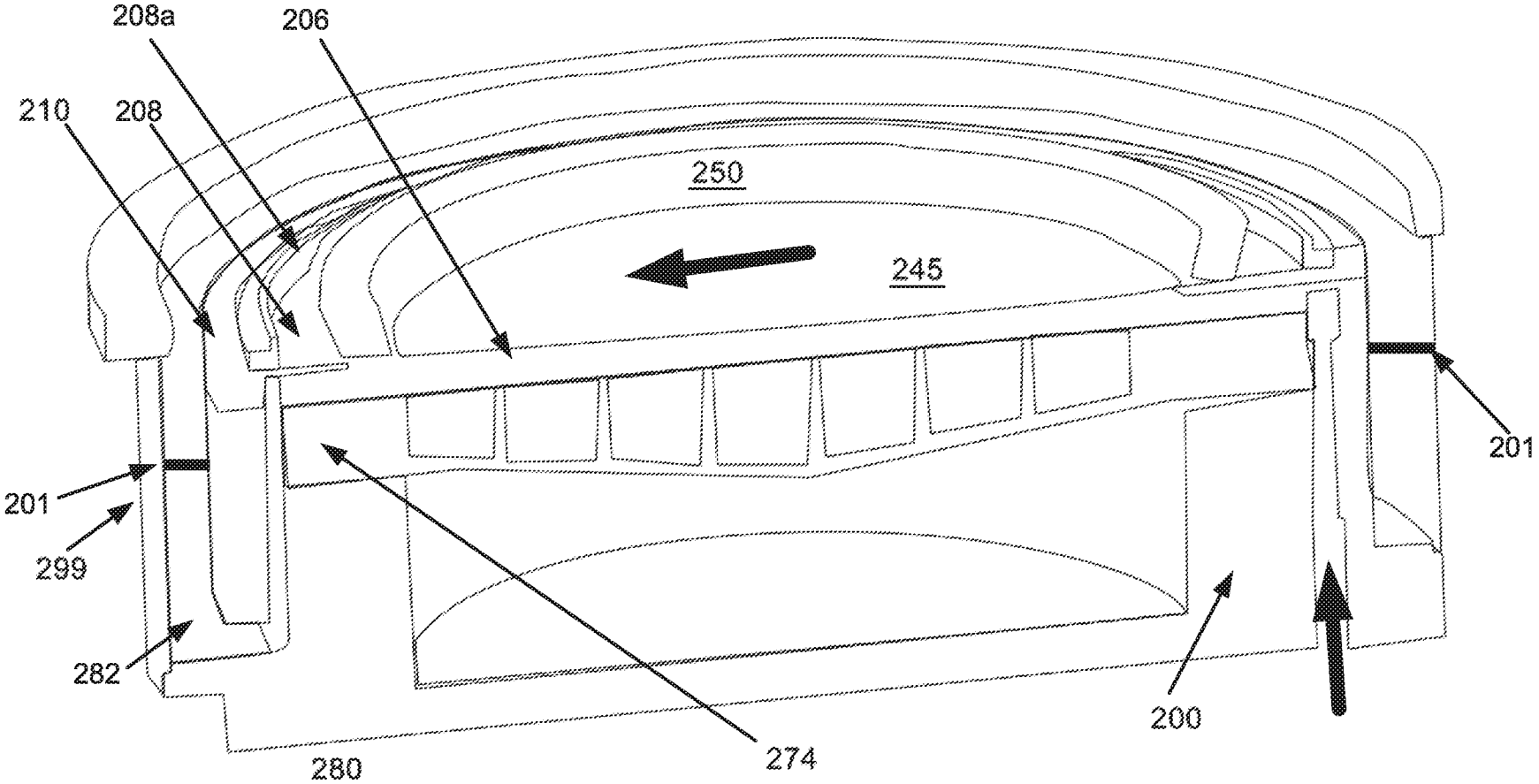
FIG. 4 depicts a cross-sectional view of various parts of the electroplating apparatus in accordance with certain disclosed embodiments.

The following embodiments assume, for the most part, that an electroplating apparatus includes a separate anode chamber. FIG. 2 shows an expanded view of certain components of an electroplating apparatus. The described features are contained in a cathode chamber, which includes a membrane frame 274 and a membrane 206 that separates the anode chamber from the cathode chamber. Any number of possible anode and anode chamber configurations may be employed. FIGS. 3 and 4 are examples of cross-sections of an apparatus showing the entry of catholyte fluid flow into the apparatus. In the following embodiments, the catholyte contained in the cathode chamber is largely located either in a processing region between the CIRP 206 and the wafer (not shown) or in channels 258 for delivering catholyte to this manifold. FIG. 3 shows a close-up cross sectional view of a cross flow inlet side according to an embodiment disclosed herein.

Much of the focus in the following description is on controlling the catholyte at the outlet to the fluid containment unit. The catholyte begins by entering the cross flow region 226 through a channel including an opening in the CIRP 206 and distribution holes 246 to the cross flow initiating structure 250. The catholyte arriving in the cross flow region 226 via the cross flow initiating structure 250 is directed substantially parallel to the face of the work piece.

As indicated in the discussion above, a "channeled ionically resistive plate" 206 (or "CIRP") is positioned between the working electrode (the wafer or substrate) and the counter electrode (the anode) during plating, in order to shape the electric field and control electrolyte flow characteristics. Various figures herein show the relative position of the CIRP 206 with respect to other structural features of the disclosed apparatus. One example of such a CIRP 206 is described in U.S. Pat. No. 8,308,931, filed Nov. 7, 2008, which was previously incorporated by reference herein in its entirety. The CIRP described therein is suitable to improve radial plating uniformity on wafer surfaces such as those containing relatively low conductivity or those containing very thin resistive seed layers. Another example is provided in U.S. Patent Application Publication No. 2017/0342590, filed on Jan. 23, 2017, which is herein incorporated by reference in its entirety. Aspects described therein are suitable for improving cross flow by using an edge flow element to control flow of fluid around the edges of the wafer. Further aspects of certain embodiments of the channeled element are described below.

A "membrane frame" 274 (sometimes referred to as an anode membrane frame in other documents) is a structural element employed in some embodiments to support a membrane 202 that separates an anode chamber from a cathode chamber. It may have other features relevant to certain embodiments disclosed herein. Particularly, with reference to the embodiments of the figures, it may include flow channel 258 for delivering catholyte toward a cross flow region 226. The plating cell may also contain a cell weir wall 282, which is useful in determining and regulating the uppermost level of the catholyte. Various figures herein depict the membrane frame 274 in the context of other structural features associated with the disclosed cross flow apparatus.

The membrane frame 274 is a rigid structural member for holding a membrane 202 that is typically an ion exchange membrane responsible for separating an anode chamber from a cathode chamber. As explained, the anode chamber may contain electrolyte of a first composition while the cathode chamber contains electrolyte of a second composition. The membrane frame 274 may also include a plurality of fluidic control rods 270 which may be used to help control fluid delivery to the CIRP 206. In some embodiments, the control rods 270 are optional. The membrane frame 274 defines the bottom-most portion of the cathode chamber and the uppermost portion of the anode chamber. The described components are all located on the work piece side of an electrochemical plating cell above the anode chamber and the membrane 202. They can all be viewed as being part of a cathode chamber. It should be understood, however, that certain implementations of a cross flow injection apparatus do not employ a separated anode chamber, and hence a membrane frame 274 is not essential.

Located generally between the work piece and the membrane frame 274 is the CIRP 206, as well as a cross flow ring gasket for some embodiments, or for alternative embodiments, a flow ring (shown in FIG. 4) and wafer cross flow confinement ring 210, which may each be affixed to the CIRP 206. More specifically, the cross flow ring gasket may be positioned directly atop the CIRP 206, and the wafer cross flow confinement ring 210 may be positioned over the cross flow ring gasket and affixed to a top surface of the CIRP 206, effectively sandwiching the gasket. Various figures herein show the wafer cross flow confinement ring 210 arranged with respect to the CIRP 206. In some embodiments, the wafer cross flow confinement ring 210 is referred to as a single-piece front side insert assembly which includes a front side insert, a flow ring (thin polymer piece), and a clamp ring to attach the flow ring to the front side insert.

Figure 8A:
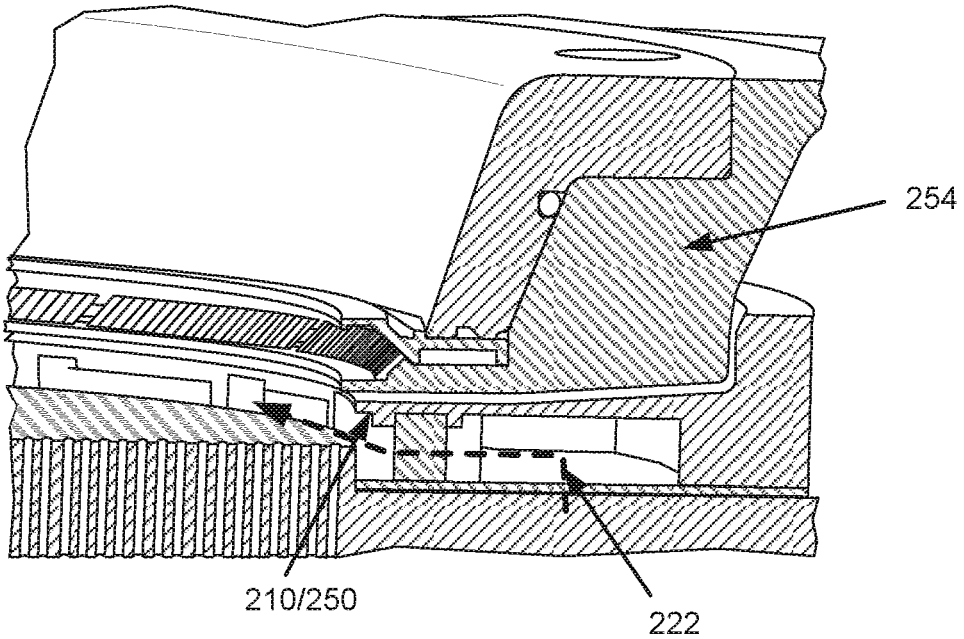
FIGS. 8A-8B depict example designs of a cross flow inlet region according to certain embodiments.
Figure 8B:
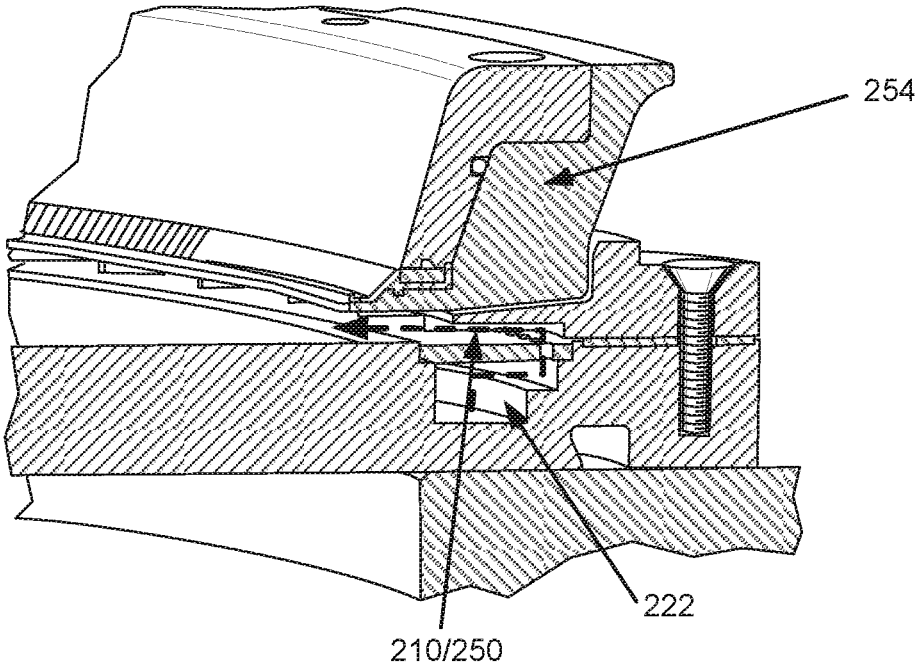

The upper most relevant structural feature of the present disclosure, as shown in FIG. 2, is a work piece or wafer holder. In certain embodiments, as shown in FIG. 2, the work piece holder may be a cup 254, which is commonly used in cone and cup clamshell type designs such as the design embodied in Novellus Systems and Lam Research's Sabre® electroplating tool mentioned above. FIGS. 2 and 8A-8B, for example, show the relative orientation of the cup 254 with respect to other elements of the apparatus. In many embodiments herein, a distance between the cup 254 and the CIRP 206 may be dynamically controlled during electroplating, as discussed further below.

In various embodiments, an edge flow element (not shown in FIG. 2) may be provided. The edge flow element may be provided at a location that is generally above and/or within a CIRP 206, and under the cup 254. The edge flow element is further described below.

Flow Paths Through Apparatus with Cross Flow Conduit

FIG. 4 shows a cross-sectional view of a plating apparatus showing both the inlet and outlet sides, in accordance with certain embodiments herein. FIG. 4 shows an illustration of a cross-section of a plating cell apparatus in accordance with certain disclosed embodiments. The plating cell apparatus includes the plating cell 200, a membrane frame 274, a front side insert 210, a flow ring 208 (with a flow ring weir 208*a*), a CIRP 206, a cross flow conduit 280 as an outlet, a cup or bus bar 250, and a wafer 245. The region between the plating cell 200 and plating cell wall 282 is a fluid containment unit for collecting overflowed catholyte during plating. The cross flow conduit 280 includes channels formed in the plating cell 200, membrane frame 274, and CIRP 206 such that fluid flow from between the CIRP 206 and wafer 245 flows under (and over, to ensure continuous wetting) the front side insert 210, down through the cross flow conduit 280, and out through the outlet depicted by the arrow into the fluid containment unit. The cross flow conduit 280 is azimuthally positioned and can be positioned either (a) opposite the cross flow inlet or (b) at a range of range of angles of CIRP circumference occupied by the cross flow conduit (e.g., about 10 to 180 degrees). The width of the cross flow conduit 280, or the opening size in the radial direction, may be between about 0.1 cm and about 1 cm. In general, the cross flow conduit 280 is "smile" shaped. Further examples are described below with respect to FIGS. 9-13.

The black horizontal lines in the fluid containment unit 282 indicate the fluid level in the containment unit during use. The arrows show the direction of flow during plating—that is, the fluid begins by flowing upward through the cross flow inlet, up through the CIRP 206 between the CIRP 206 and the wafer 245 in the direction of cross flow depicted with the large arrow, then down below the insert 210, through the cross flow conduit 280, and out to the fluid containment unit 282.

During a plating process, catholyte fills and occupies the region between the top of the membrane 202 on the membrane frame 274 and the cross flow region 226 with fluid level in the fluid containment bound by the cell weir wall 282. This catholyte region can be subdivided into three sub-regions: 1) a CIRP manifold region 208 below the CIRP 206 and (for designs employing an anode chamber cationic membrane) above the separated-anode-chambers cationic-membrane 202 (this element is also sometimes referred to as a lower manifold region 208), 2) the cross flow region 226, between the wafer and the upper surface of the CIRP 206, and 3) an upper cell region or "electrolyte containment region", outside of the clamshell/cup 254, with fluid level above the insert and within a fluid containment unit inside the cell weir wall 282. When the wafer is not immersed and the clamshell/cup 254 is not in the down position, the second region and third region are combined into one region.

Region (2) above, between the top of the CIRP 206 and the bottom of the work piece when installed in the work piece holder 254 contains catholyte and is referred to as the "cross flow region" 226. The gap formed in this region as measured from the surface of the work piece to the top surface of the CIRP 206 may be very small, such as between about 0.5 mm and about 15 mm, or in one example, about 2 mm. The diameter of the cross flow region 226 is general defined by the diameter of the wafer but may vary in size, from about 150 mm (for smaller diameter wafers) up to ~500 mm (for larger diameter wafers). In general, the shape of the cross flow region 226 is flat and circular.

Flow rate of fluid through the cross flow region 226 can vary depending on different configurations. For a 300 mm wafer and a 2 mm height of the cross flow region 26, the flow rate for a single cell may be at least about 20 L/min, or at least about 25 L/min, or between about 6 L/min and about 60 L/min, or between about 20 L/min or about 50 L/min.

In some embodiments, catholyte enters the cathode chamber via a single inlet port. In other embodiments, catholyte enters the cathode chamber through one or more ports located elsewhere in the plating cell. In some cases, there is a single inlet for the bath of the cell, peripheral to the anode chamber and cut out of the anode chamber cell walls. This inlet connects to a central catholyte inlet manifold at the base of the cell and anode chamber. In certain disclosed embodiments, that main catholyte manifold chamber feeds a plurality of catholyte chamber inlet holes (e.g., 12 catholyte chamber inlet holes). In various cases, these catholyte chamber inlet holes are divided into two groups: one group which feeds catholyte to a cross flow injection manifold 222, and a second group which feeds catholyte to the CIRP manifold 208. In various embodiments, catholyte flows only via cross flow without perpendicular flow upwards through the membrane or via the CIRP manifold 208; however, in some embodiments, the CIRP manifold 208 includes catholyte but plating is performed primarily by the cross flow in the cross flow region 226.

As mentioned, the catholyte entering the cathode chamber flows into the cross flow injection manifold 222, through the holes 246 in the showerhead 242, and then into the cross flow region 226. The flow directly entering from the cross flow injection manifold region 222 may enter via the cross flow confinement ring entrance ports, sometimes referred to as cross flow side inlets 250, and emanate parallel to the wafer and from one side of the cell.

In some embodiments, the fluid entering the cathode chamber is directed into multiple channels distributed around the periphery of the cathode chamber portion of the electroplating cell chamber (often a peripheral wall). In a specific embodiment, there are 12 such channels contained in the wall of the cathode chamber.

The channels in the cathode chamber walls may connect to corresponding "cross flow feed channels" in the membrane frame. Some of these feed channels deliver catholyte directly to the CIRP manifold 208. In some embodiments, a CIRP 206 may include microchannels for flowing fluid up directly to the cross flow region 226. While not described, all embodiments herein may be implemented in a way that includes not only cross flowing electrolyte, upward flowing electrolyte through the channels in the CIRP to impinge on wafer surface. Where microchannels are used, the catholyte provided to this manifold subsequently passes through the small vertically oriented channels of the CIRP 206 and enters the cross flow region 226 as jets of catholyte.

As mentioned, in an embodiment depicted in the figures, catholyte feeds the "CIRP manifold chamber" 208 through 6 of the 12 catholyte feeder lines/tubes. Those 6 main tubes or lines 262 feeding the CIRP manifold 208 reside below the cross flow confinement ring's exit cavity 234 (where the fluid passes out of the cross flow region 226 below the wafer), and opposite all the cross flow region components (cross flow injection manifold 222, showerhead 242, and confinement ring entrance cavity 250).

As depicted in various figures, some cross flow feed channels 258 in the membrane frame lead directly to the cross flow injection manifold 222 (e.g., 6 of 12). These cross flow feed channels 258 start at the base of the anode chamber of the cell and then pass through matching channels of the membrane frame 274 and then connect with corresponding cross flow feed channels 258 on the lower portion of the CIRP 206. See FIG. 3, for example.

In a specific embodiment, referring to FIG. 3, there are six separate feed channels 258 for delivering catholyte directly to the cross flow injection manifold 222 and then to the cross flow region 226. In order to effect cross flow in the cross flow region 226, these channels 258 exit into the cross flow region 226 in an azimuthally non-uniform manner Specifically, they enter the cross flow region 226 at a particular side or azimuthal region of the cross flow region 226. In a specific embodiment depicted in FIG. 3, the fluid paths 258 for directly delivering catholyte to the cross flow injection manifold 222 pass through four separate elements before reaching the cross flow injection manifold 222: (1) dedicated channels in the cell's anode chamber wall, (2) dedicated channels in the membrane frame 274, (3) dedicated channels the CIRP 206 (i.e., not the 1-D channels used for delivering catholyte from the CIRP manifold 208 to the cross flow region 226), and finally, (4) fluid paths in the wafer cross flow confinement ring 210.

As mentioned, the portions of the flow paths passing through the membrane frame 274 and feeding the cross flow injection manifold 222 are referred to as cross flow feed channels 258 in the membrane frame. In various embodiments, microchannels are not present in the CIRP and are not used to deliver catholyte to the cross flow region 226. However, if microchannels are in the CIRP, the "cross flow feed channel" includes both the catholyte feed channels 258 feeding the cross flow injection manifold 222 and the catholyte feed channels feeding the CIRP manifold 208. Where microchannels are not used, the cross flow feed channel includes catholyte feed channels 258 feeding the cross flow injection manifold 222.

Referring to FIG. 3, the flow path of the catholyte moves in a vertically upward direction as it passes through the cross flow feed channel 258 in the plate 206, and then enters a cross flow injection manifold 222 formed within the body of the CIRP 206. The cross flow injection manifold 222 is an azimuthal cavity which may be a dug out channel within the CIRP 206 that can distribute the fluid from the various individual feed channels 258 (e.g., from each of the individual 6 cross flow feed channels) to the various multiple flow distribution holes 246 of the cross flow shower head plate 242. This cross flow injection manifold 222 is located along an angular section of the peripheral or edge region of the CIRP 206. See for example FIG. 3. In certain embodiments, the cross flow injection manifold 222 forms a C-shaped structure over an angle of about 90 to 180° of the plate's perimeter region. In certain embodiments, the angular extent of the cross flow injection manifold 222 is about 120 to about 170°, and in a more specific embodiment is between about 140 and 150°. In these or other embodiments, the angular extent of the cross flow injection manifold 222 is at least about 90°. In many implementations, the showerhead 242 spans approximately the same angular extent as the cross flow injection manifold 222. Further, the overall inlet structure 250 (which in many cases includes one or more of the cross flow injection manifold 222, the showerhead 242, the showerhead holes 246, and an opening in the cross flow confinement ring) may span these same angular extents.

Figure 5:
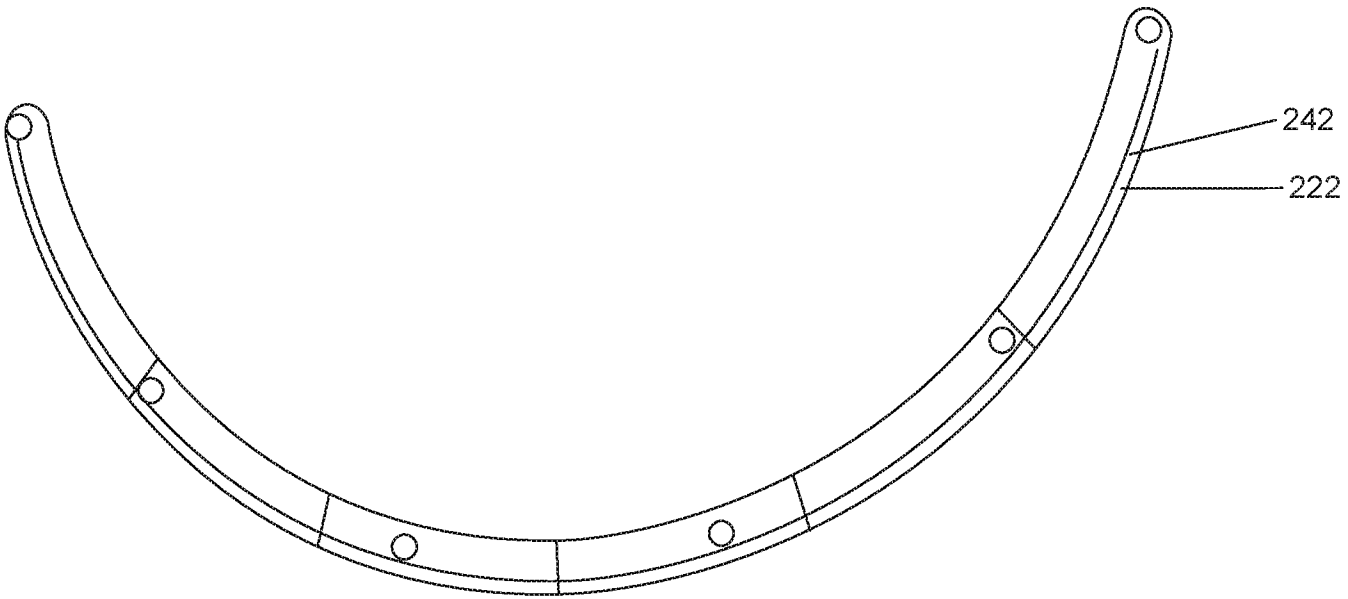
FIG. 5 shows a cross flow injection manifold and showerhead split into 6 individual segments.

In some embodiments, the cross flow in the injection manifold 222 forms a continuous fluidically coupled cavity within the CIRP 206. In this case all of the cross flow feed channels 258 feeding the cross flow injection manifold (e.g., all 6) exit into one continuous and connected cross flow injection manifold chamber. In other embodiments, the cross flow injection manifold 222 and/or the cross flow showerhead 242 are divided into two or more angularly distinct and completely or partially separated segments, as shown in FIG. 5 (which shows 6 separated segments). In some embodiments, the number of angularly separated segments is between about 1-12, or between about 4-6. In a specific embodiment, each of these angularly distinct segments is fluidically coupled to a separate cross flow feed channel 258 disposed in the CIRP 206. Thus, for example, there may be six angularly distinct and separated subregions within the cross flow injection manifold 222. In certain embodiments, each of these distinct subregions of the cross flow injection manifold 222 has the same volume and/or the same angular extent.

In many cases, catholyte exits the cross flow injection manifold 222 and passes through a cross flow showerhead plate 242 having many angularly separated catholyte outlet ports (holes) 246. See for example FIGS. 3 and 6.

Flow Paths to Cross Flow Conduit

Figure 6:
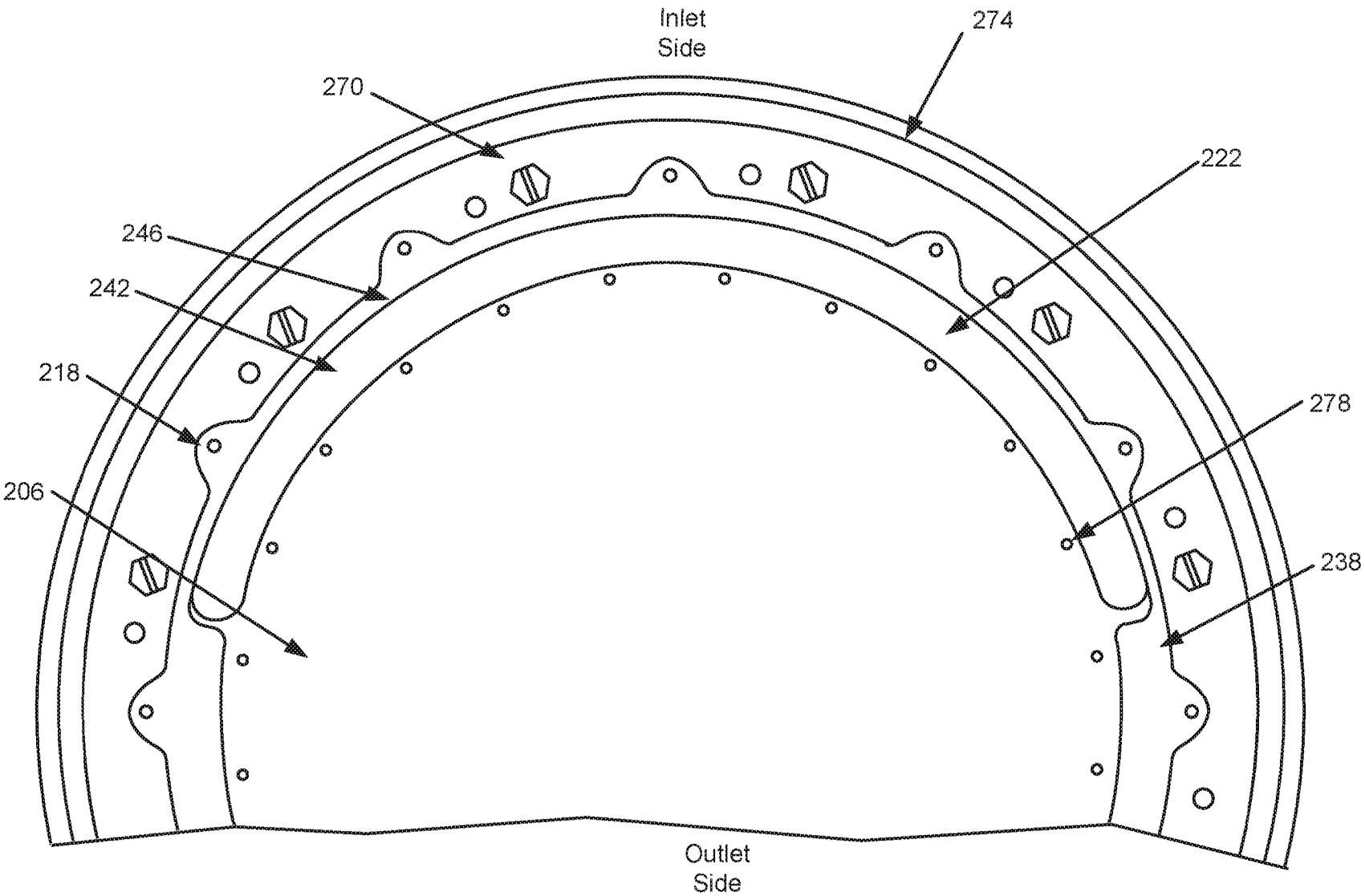
FIG. 6 shows a top view of a CIRP and associated hardware, focusing especially on the inlet side of the cross flow.

FIG. 6 shows a top view of the cross flow region 226 depicting an embedded cross flow injection manifold 222 within the CIRP 206, along with the showerhead 242 and 139 outlet holes 246. All six fluidic adjustment rods 270 for the cross flow injection manifold flow are also shown. The cross flow confinement ring 210 is not installed in this depiction, but the outline of the cross flow confinement ring sealing gasket 238, which seals between the cross flow confinement ring 210 and the upper surface of the CIRP 206, is shown. Other elements which are shown in FIG. 6 include the cross flow confinement ring fasteners 218, membrane frame 274, and screw holes 278 on the anode side of the CIRP 206 (which may be used for a cathodic shielding insert, for example).

In some embodiments, the geometry of the cross flow confinement ring outlet 234 may be tuned in order to further optimize the cross flow pattern. For example, a case in which the cross flow pattern diverges to the edge of the confinement ring 210 may be corrected by reducing the open area in the outer regions of the cross flow confinement ring outlet 234. In certain embodiments, the outlet manifold 234 may include separated sections or ports, much like the cross flow injection manifold 222. In some embodiments, the number of outlet sections is between about 1-12, or between about 4-6. The ports are azimuthally separated, occupying different (usually adjacent) positions along the outlet manifold 234. The relative flow rates through each of the ports may be independently controlled in some cases. This control may be achieved, for example, by using control rods 270 similar to the control rods described in relation to the inlet flow. In another embodiment, the flow through the different sections of the outlet can be controlled by the geometry of the outlet manifold. For example, an outlet manifold that has less open area near each side edge and more open area near the center would result in a solution flow pattern where more flow exits near the center of the outlet and less flow exits near the edges of the outlet. Other methods of controlling the relative flow rates through the ports in the outlet manifold 234 may be used as well (e.g., pumps, etc.).

As mentioned, bulk catholyte entering the catholyte chamber is directed separately into the cross flow injection manifold 222 and the CIRP manifold 208 through multiple channels 258 and 262, e.g., 12 separate channels. In certain embodiments, the flows through these individual channels 258 and 262 are independently controlled from one another by an appropriate mechanism. In some embodiments, this mechanism involves separate pumps for delivering fluid into the individual channels. In other embodiments, a single pump is used to feed a main catholyte manifold, and various flow restriction elements that are adjustable may be provided in one or more of the channels feeding the flow path provided so as to modulate the relative flows between the various channels 258 and 262 and between the cross flow injection manifold 222 and CIRP manifold 208 regions and/or along the angular periphery of the cell. In various embodiments depicted in the figures, one or more fluidic adjustment rods 270 (sometimes also referred to as flow control elements) are deployed in the channels where independent control is provided. In the depicted embodiments, the fluidic adjustment rod 270 provides an annular space in which catholyte is constricted during its flow toward the cross flow injection manifold 222 or the CIRP manifold 208. In a fully retracted state, the fluidic adjustment rod 270 provides essentially no resistance to flow. In a fully engaged state, the fluidic adjustment rod 270 provides maximal resistance to flow, and in some implementations stops all flow through the channel. In intermediate states or positions, the rod 270 allows intermediate levels of constriction of the flow as fluid flows through a restricted annular space between the channel's inner diameter and the fluid adjustment rod's outer diameter.

In some embodiments, the adjustment of the fluidic adjustment rods 270 allows the operator or controller of the electroplating cell to favor flow to either the cross flow injection manifold 222 or to the CIRP manifold 208. In certain embodiments, independent adjustment of the fluidics adjustment rods 270 in the channels 258 that deliver catholyte directly to the cross flow injection manifold 222 allows the operator or controller to control the azimuthal component of fluid flow into the cross flow region 226.

In certain embodiments, the cross flow showerhead plate 242 is integrated into the CIRP 206, as shown in FIG. 6 for example. In some embodiments the showerhead plate 242 is glued, bolted, or otherwise affixed to the top of the cross flow injection manifold 222 of the CIRP 206. In certain embodiments, the top surface of the cross flow showerhead 242 is flush with or slightly elevated above a plane or top surface of the CIRP 206. In this manner, catholyte flowing through the cross flow injection manifold 222 may initially travel vertically upward through the showerhead holes 246 and then laterally under the cross flow confinement ring 210 and into the cross flow region 226 such that the catholyte enters the cross flow region 226 in a direction that is substantially parallel with the top face of the channeled ionically resistive plate. In other embodiments, the showerhead 242 may be oriented such that catholyte exiting the showerhead holes 246 is already traveling in a wafer-parallel direction.

In a specific embodiment, the cross flow showerhead 242 has 139 angularly separated catholyte outlet holes 246. More generally, any number of holes that reasonably establish uniform cross flow within the cross flow region 226 may be employed. In certain embodiments, there are between about 50 and about 300 such catholyte outlet holes 246 in the cross flow showerhead 242. In certain embodiments, there are between about 100 and 200 such holes. In certain embodiments, there are between about 120 and 160 such holes. Generally, the size of the individual ports or holes 246 can range from about 0.020" to 0.10", more specifically from about 0.03" to 0.06" in diameter.

In certain embodiments, these holes 246 are disposed along the entire angular extent of the cross flow showerhead 242 in an angularly uniform manner (e.g., the spacing between the holes 246 is determined by a fixed angle between the cell center and two adjacent holes). See for example FIGS. 3 and 7. In other embodiments, the holes 246 are distributed along the angular extent in an angularly non-uniform manner. In further embodiments, the angularly non-uniform hole distribution is nevertheless a linearly ("x" direction") uniform distribution. Put another way, in this latter case, the hole distribution is such that the holes are spaced equally far apart if projected onto an axis perpendicular to the direction of cross flow (this axis is the "x" direction). Each hole 246 is positioned at the same radial distance from the cell center, and is spaced the same distance in the "x" direction from adjacent holes. The net effect of having these angularly non-uniform holes 246 is that the overall cross flow pattern is much more uniform.

In certain embodiments, the direction of the catholyte exiting the cross flow showerhead 242 is further controlled by a wafer cross flow confinement ring 210. In certain embodiments, this ring 210 extends over the full circumference of the CIRP 206. In certain embodiments, a cross section of the cross flow confinement ring or front side insert 210 has an L-shape, as shown in FIGS. 3 and 4. In certain embodiments, the wafer cross flow confinement ring 210 contains a series of flow directing elements such as directional fins 266 in fluidic communication with the outlet holes 246 of the cross flow showerhead 242. More specifically, the directional fins 266 define largely segregated fluid passages under an upper surface of the wafer cross flow confinement ring 210 and between adjacent directional fins 266. In some cases, the purpose of the fins 266 is to redirect and confine flow exiting from the cross flow showerhead holes 246 from an otherwise radially inward direction to a "left to right" flow trajectory (left being the inlet side 250 of the cross flow, right being the outlet side 234). This helps to establish a substantially linear cross flow pattern. The catholyte exiting the holes 246 of the cross flow showerhead 242 is directed by the directional fins 266 along a flow streamline caused by the orientation of the directional fins 266. In certain embodiments, all the directional fins 266 of the wafer cross flow confinement ring 210 are parallel to one another. This parallel arrangement helps to establish a uniform cross flow direction within the cross flow region 226. In various embodiments, the directional fins 226 of the wafer cross flow confinement ring 210 are disposed both along the inlet 250 and outlet 234 side of the cross flow region 226. This is illustrated in the top view of FIG. 7, for example.

As indicated, catholyte flowing in the cross flow region 226 generally passes from an inlet region 250 of the wafer cross flow confinement ring 210 to an outlet side 234 of the ring 210, which implements a cross flow conduit which is further described below with respect to FIGS. 9-13. A certain amount of catholyte may also leak out around the entire periphery of the substrate. This leakage may be minimal in comparison to the amount of catholyte leaving the cross flow region at the outlet side 234. At the outlet side 234, in certain embodiments, there are multiple directional fins 266 that may be parallel to and may align with the directional fins 266 on the inlet side. The cross flow passes through channels created by the directional fins 266 on the outlet side 234 and then ultimately and directly out of the cross flow region 226. The flow then passes into another region of the cathode chamber generally radially outwards and beyond the wafer holder 254 and cross flow confinement ring 210, then via the cross flow conduit 280 to a fluid containment unit bound by the plating cell weir wall 282 for collection and recirculation. It should therefore be understood that the figures (e.g., FIGS. 3 and 4) show only a partial path of the entire circuit of catholyte entering and exiting the cross flow region. Note that, in the embodiment depicted in FIGS. 3 and 4, for example, fluid exiting from the cross flow region 226 does not pass through small holes or back through channels analogous to the feed channels 258 on the inlet side, but rather passes outward in a generally parallel-to-the wafer direction as it is accumulated in the aforementioned accumulation region.

Cross Flow Injection Mold and Flow Path Entry

FIGS. 8A-8B show cross sectional views of a cross flow injection manifold 222 and corresponding cross flow inlet 250 relative to a plating cup 254. The position of the cross flow inlet 250 is defined, at least in part, by the position of the cross flow confinement ring 210. Specifically, the inlet 250 may be considered to begin where the cross flow confinement ring 210 terminates. Note that in the case of an initial design, seen in FIG. 8A, the confinement ring 210 termination point (and inlet 250 commencement point) was under the edge of the wafer, whereas in a revised design, seen in FIG. 8B, the termination/commencement point is under the plating cup and further radially outward from the wafer edge, as compared to the initial design. Also, the cross flow injection manifold 222 in the earlier design had a step in the cross flow ring cavity (where the generally leftward arrow begins rising upwards) which potentially formed some unwanted turbulence near that point of fluid entry into the cross flow region 226. In some cases, an edge flow element (not shown) may be present proximate the periphery of the substrate and/or the periphery of the channeled ionically resistive plate. The edge flow element may be present proximate the inlet 250 and/or proximate the outlet (not shown in FIGS. 8A and 8B). The edge flow element may be used to direct electrolyte into a corner that forms between the plating face of the substrate and the edge of the cup 254, thereby counteracting an otherwise relatively low cross flow in this region.

Cross Flow Conduit Components

As noted above with respect to FIG. 4, provided herein are apparatuses and methods for diverting cross flow in an electroplating cell to reduce foam production and improve electrolyte flow during plating. Various embodiments disclosed herein involve a flow diversion device, referred to as a cross flow conduit (CFC), that diverts the cross flow as it exits the region underneath the wafer in order to minimize splashing, air entrainment, and subsequent foaming Certain plating chemistries contain additives that are prone to generating foam at high convection. Significant foam generation can cause errors with level sensors in the plating cell and bath reservoir and can contaminate and corrode parts if the foam grows and migrates to other areas of the plating hardware.

As opposed to exiting the channeled ionic resistive plate (CIRP) by flowing over top of the CIRP weir or any other weir (shown in FIGS. 1C and 1D), the cross flow solution is diverted into a cross flow conduit which includes a cut-out in the CIRP, a cut-out in the membrane frame, and a cut-out in the cell, and then flowed out into the outer cell fluid containment unit where it collects before draining back to the bath. The point where the flow exits the CFC and meets with the collected solution in the plating cell containment is below the solution level. That is, it flows underneath the liquid surface as opposed to falling into the reservoir—more analogous to an under-tow as opposed to a waterfall.

In various embodiments, the cross flow conduit can also include various restrictor plates to maintain sufficient solution level above CIRP, which is necessary for proper wafer wetting on entry. The restrictor plates can be fixed, with variable-aperture design, or by modulated by a pressure relief valve. The cross flow conduit can be built into the various hardware components (front side insert, CIRP, membrane frame, cell) or can be an attachable piece that mounts onto and utilizes existing hardware. These various embodiments are described with respect to FIGS. 9-14 below.

Figure 9:
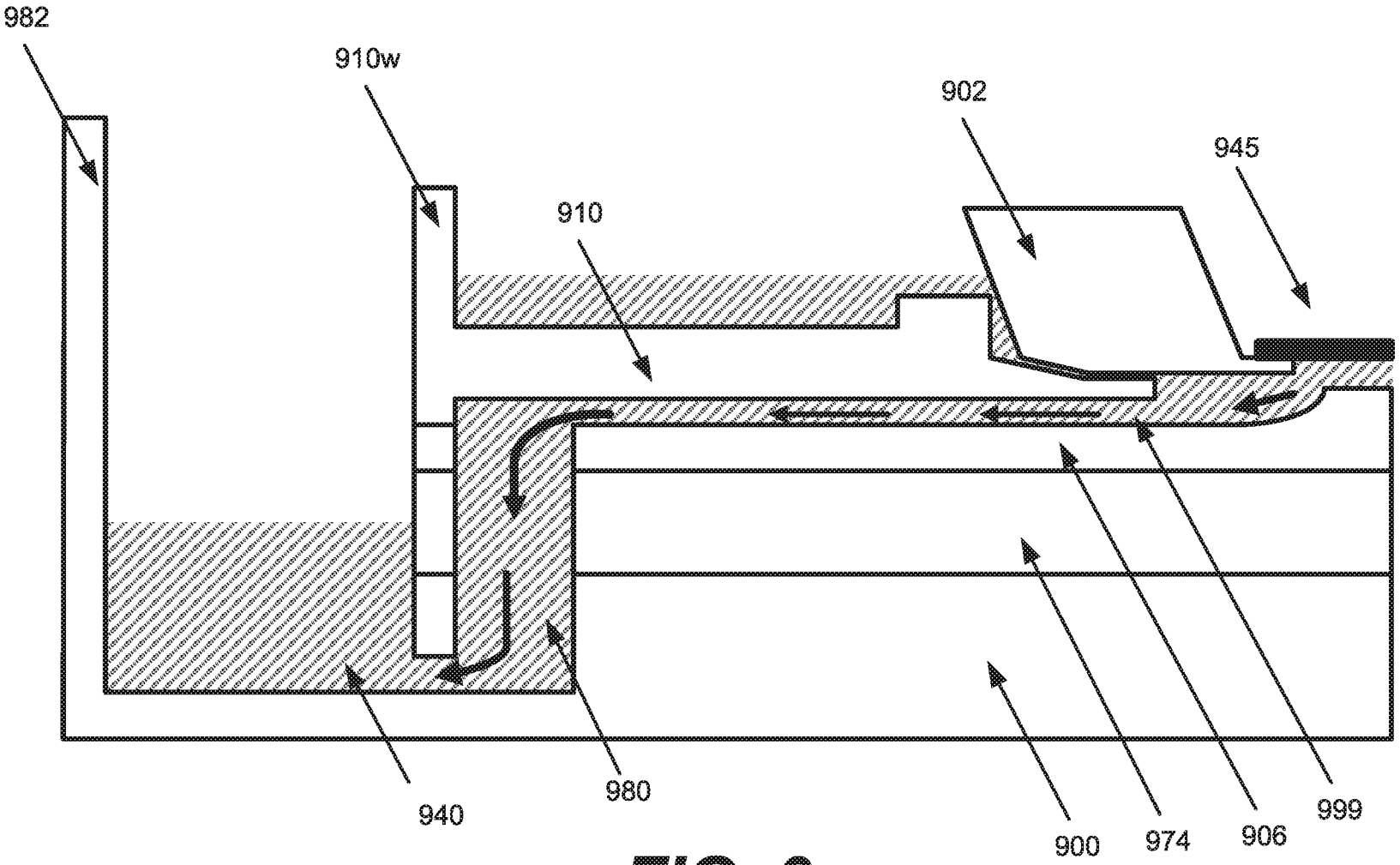
FIG. 9 shows a close-up view of a cross flow outlet, a CIRP, membrane frame, cross flow conduit and surrounding hardware in accordance with various disclosed embodiments.

One embodiment involves a flow diversion device, referred to as a cross flow conduit (CFC), that diverts the cross flow as it exits the region underneath the wafer in order to minimize splashing, air entrainment, and subsequent foaming. An example is provided in FIG. 9. FIG. 9 shows a simplified illustration of a cross section of a portion of a plating cell apparatus where the catholyte exits in accordance with certain disclosed embodiments. The cross section includes a plating cell 900 having a cell weir wall 982 where the fluid containment unit 940 holds the fluid from the plating cell 900 when it exits on the exiting side of the cross flow. The plating cell 900 includes a CIRP 906, and a membrane frame 974. A channel has been cut into the CIRP (at the edge nearest the cross flow exit). The same channel has been cut into the membrane frame 974 and plating cell 900. Together these channels create a cross flow conduit 980 with the front side insert 910 serving as the roof/ceiling of the CFC) that diverts the cross flow solution to the bottom of the fluid containment 940 (under solution level) without mixing with air. Due to minimal interaction of fluid and air, and since fluid no longer impinges on the cell wall 982 when exiting the cross flow, foam generation is prevented. The plating cell 900 also includes an outlet to the fluid containment unit 940. The CIRP 906 and insert 910 are separated by a narrow channel 999, such that the insert 910 is used to hold a cup 902 in place for holding the wafer 945. The insert 910 includes a weir wall 910*w* to contain a flooded region of fluid over the top of the insert 910 to ensure continuous flow of fluid over the wafer 945. The fluid flow from the cross flow flows under the wafer 945, under the cup 902 in a narrow gap between the cup and the CIRP, and through the narrow channel 999 between the insert 910 and CIRP 906 and down through the cross flow conduit 980 to the fluid containment unit 940, where fluid is then recirculated and repumped back to the inlet on the other side of the plating cell.

Figure 10:
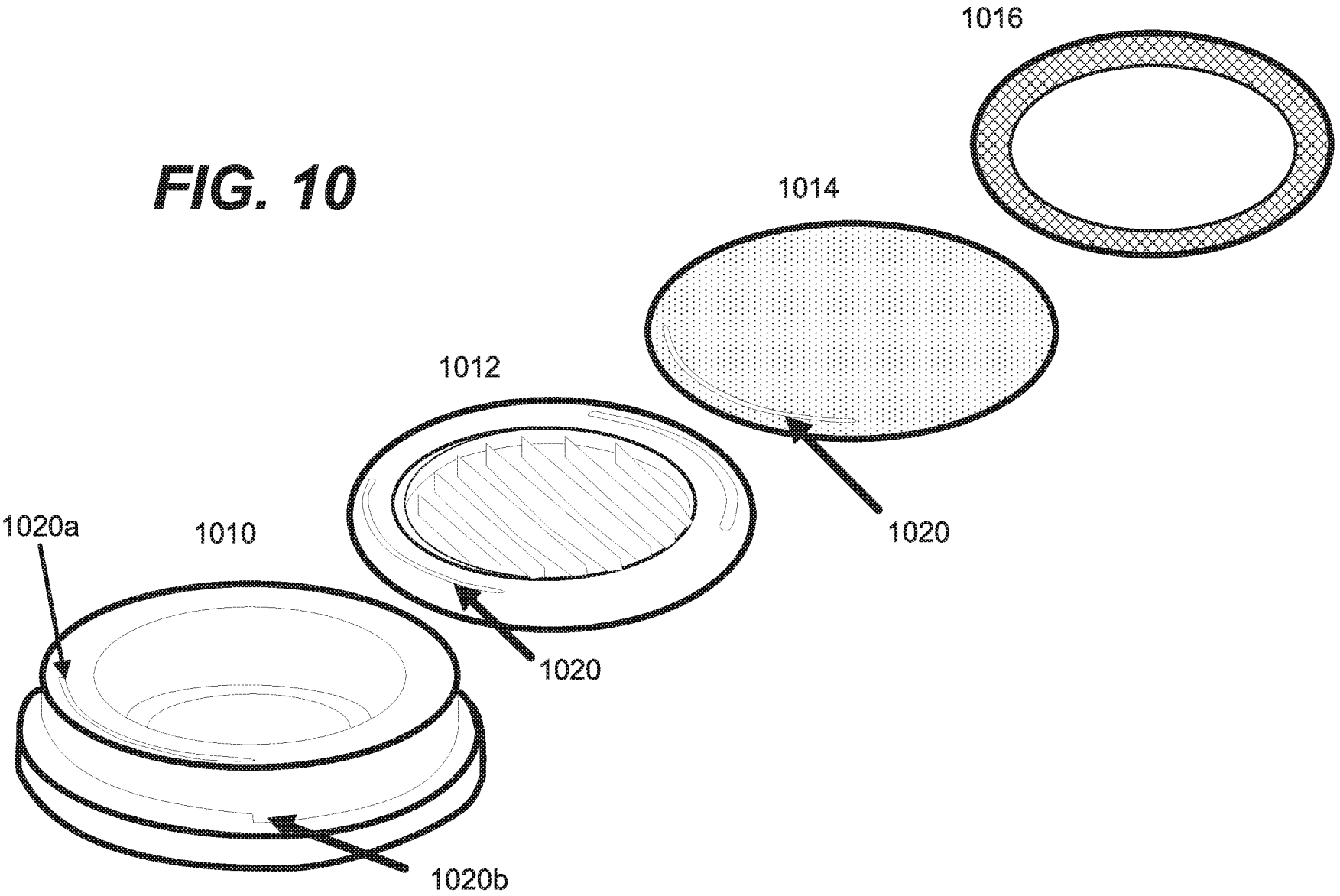
FIG. 10 shows an exploded view of an embodiment with four modified components of the plating cell, membrane frame, CIRP, and front side insert for using a cross flow conduit in accordance with certain disclosed embodiments.

FIG. 10 shows an exploded view of the different components of the plating cell, including, from left to right, the plating cell 1010, the membrane frame 1012, the CIRP 1014, and front side insert 1016. The CIRP 1014, membrane frame 1012, and cell 1010 each include an opening 1020 on the outlet side of the annular shape such that when these openings are aligned, a cross flow conduit is formed to allow fluid flow downward through the CIRP opening, membrane frame opening, and cell opening (each referred to as a component of the cross flow conduit) to the outlet. The illustration of the cell shows that the top of the opening is the cross flow conduit inlet 1020*a*, and the bottom of the opening is the cross flow conduit outlet 1020*b*. The cross flow conduit 1020 is also shown in both the membrane frame and the CIRP. The bottom of the front side insert 1016 serves as a "roof" of the cross flow conduit as described above with respect to FIG. 9. The cross flow conduit 1020, also referred to as a channel above formed by the openings of the cell, membrane frame, CIRP, and bound by the bottom surface of the insert, is a channel in which cross-flow is diverted from atop the CIRP to below fluid level into the containment region without turbulent mixing with air. The cross flow conduit may span four pieces of the overall plating cell apparatus.

Certain disclosed embodiments are suitable for using ultra-high cross flow for all plating chemistries, regardless of any chemistry's inherent tendency for foaming. This will result in improved plating performance, including: higher Ag % incorporation, improved WiF uniformity, skirting reduction, lower WiD for die types containing features of different critical dimensions, and others. WiF is within-feature non-uniformity, and is a measure of the individual feature (bump/pillar) top profile shape. It is determined by taking the max height minus the min height for each feature, averaged over all features. Typically, a flat feature top is preferred, having a small WiF, as opposed to a domed feature top having a higher WiF. WiD is within-die non-uniformity, and is a measure of the variation of height of all the features within a die. It is typically calculated by taking the bump height half-range in each die, (max−min)/2, averaged over the whole wafer, divided by the average bump height, reported as percentage. Lower WiD values are preferred, as they will ensure that proper solder contact is made with all of bumps when the final package is assembled. Improved convection also results in better ion transport to feature bottoms, which increases plating rates and thus overall higher wafer throughput.

Flow Restrictor

Some embodiments described herein also include an optional flow restrictor which may be a flow restrictor plate or valve. The flow restrictor plate can be used with the cross flow conduit to modulate the flow of fluid allow fluid to exit through the outlet while maintaining a continuous flow of fluid on the wafer by ensuring a sufficient fluid level is maintained above the insert. In general, flow restrictors may block between about 15% and about 85% of the opening in the cross flow conduit. In some embodiments, the flow restrictor plate is a "smile" shaped plates with a variety of holes cut within it to vary the flow restriction across different areas of the cross flow conduit. For example, there may be between about 25 holes and about 75 holes, or one continuous hole, or up to 500 tiny holes. Each hole may be the same size or may be different sizes depending on the desired flow. The thickness of the flow restrictor plate may be between about 1 mm and about 75 mm and may span up to 100% of the length of the cross flow conduit radially from one end of the cross flow conduit to another end. In various embodiments, the flow restrictor plate is placed between the membrane frame and cell but may be placed in other areas of the cross flow conduit. In various embodiments, a flow restrictor valve is placed in the cross flow conduit.

Figure 11A:
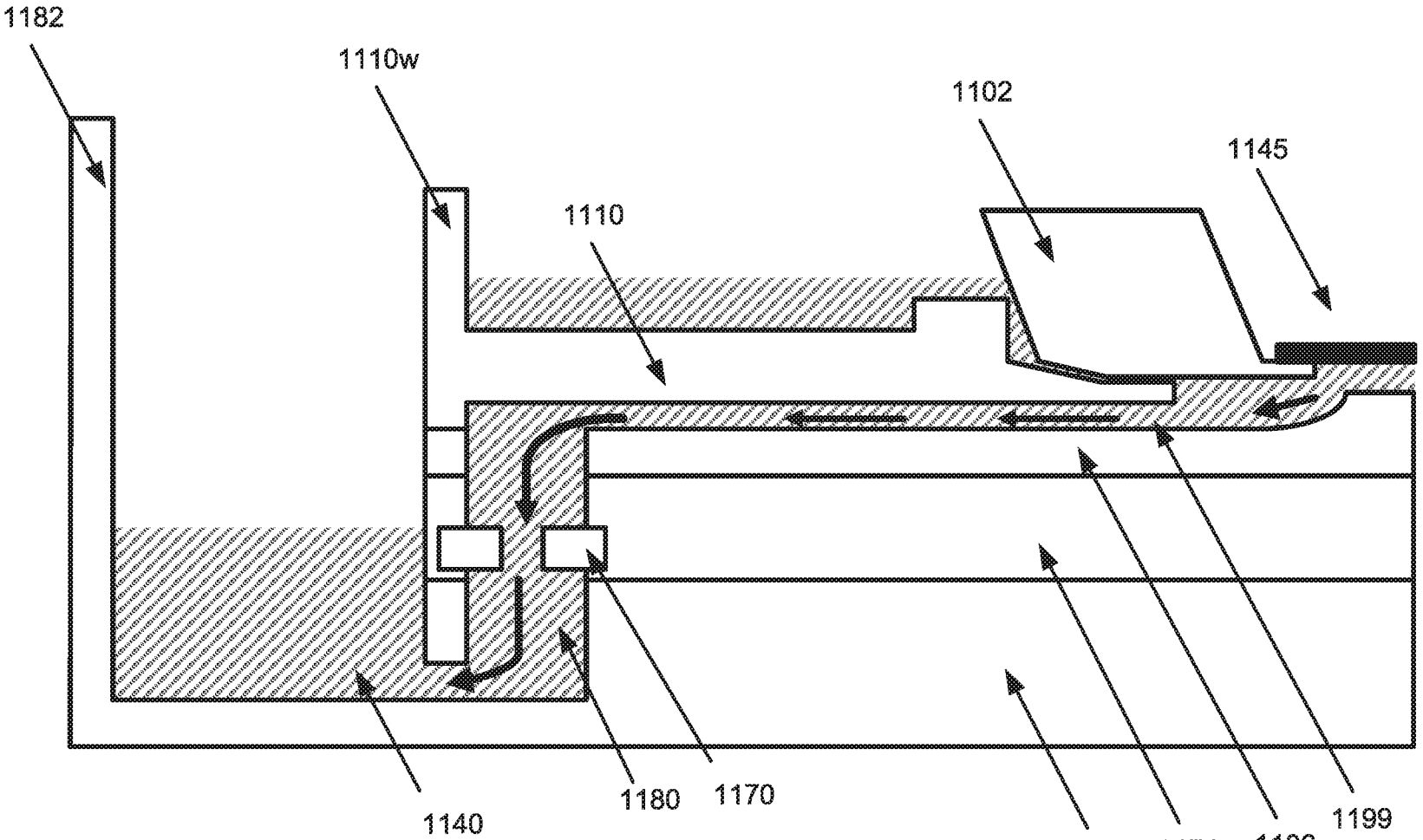
FIG. 11A shows a close-up view of a cross section of a cross flow conduit having a fixed flow restrictor plate in accordance with certain disclosed embodiments.
Figure 11B:
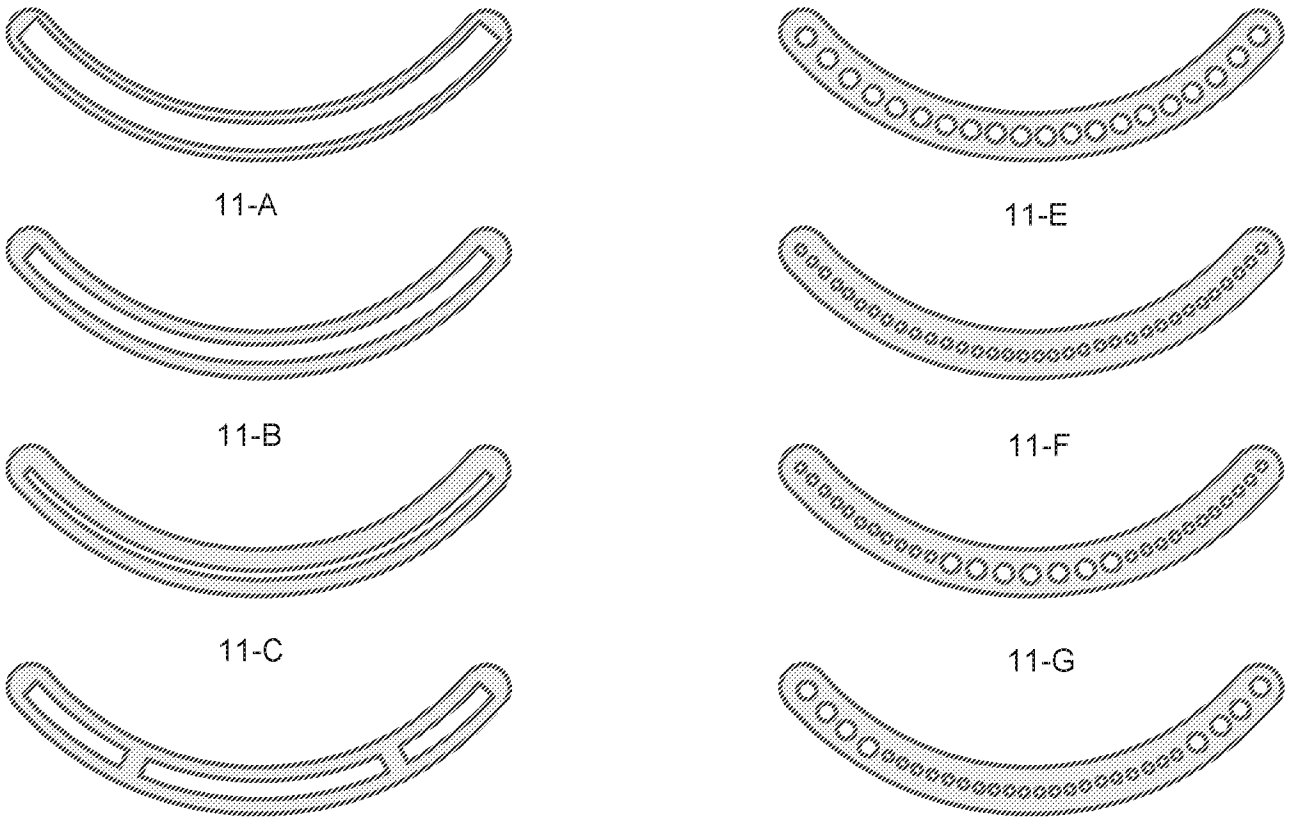
FIG. 11B shows various designs of flow restrictor plates that may be used in conjunction with certain disclosed embodiments.

FIG. 11A shows an example of a flow restrictor plate 1170 between the membrane frame 1174 and plating cell 1100 having a cup 1102, wafer 1145, insert 1110 with weir 1110*w*, CIRP 1106, membrane frame 1174, plating cell weir wall 1140, and fluid containment unit 1140. This example involves fixed plates with fixed apertures for modulating flow in the cross flow conduit 1180 using flow restrictor plate 1170. It is carefully made to reduce unnecessary pressure to the plating solution pump while ensuring proper wafer wetting on entry by maintaining enough restriction for the top of the insert 1110 to continuously wetted with sufficient fluid level. In this embodiment, the weir has been moved from the CIRP to the flow insert 1110 as depicted at insert weir 1110*w*. Flow arrows 1199 show the direction of flow. The flow restrictor plate 1170 is attached to CFC 1180 in between the plating cell 1100 and the membrane frame 1174. An appropriate restrictor can be selected to maintain sufficient fluid level above the CIRP/insert (which is necessary for proper wafer wetting on entry) while not over-restricting the exit (adding unnecessary pressure head to the plating solution pump). Restrictor plates can be made in a variety of outlet opening areas and geometries and out of various materials (for example, stainless steel, titanium, polyethylene terephthalate (PET), polycarbonate, and polytetrafluoroethylene (PTFE)). Examples of various geometries are provided in FIG. 11B. 11-A, 11-B, and 11-C show various options for a single, continuous hole in the flow restrictor plate, each hole being a different size of the opening but all spanning across the entire plate evenly. 11-D includes three separate cavities of certain openings (although the openings are depicted to be similar in size, it will be understood that a variety of sizes and shapes of cavities may be used). Additionally, 11-E, 11-F, 11-G, and 11-H show options for using circular holes with varying types of holes that may be used in accordance to the desired flow. Each restrictor plate is a single, fixed size and must be manually replaced if a different restrictor plate is desired.

Figure 12:
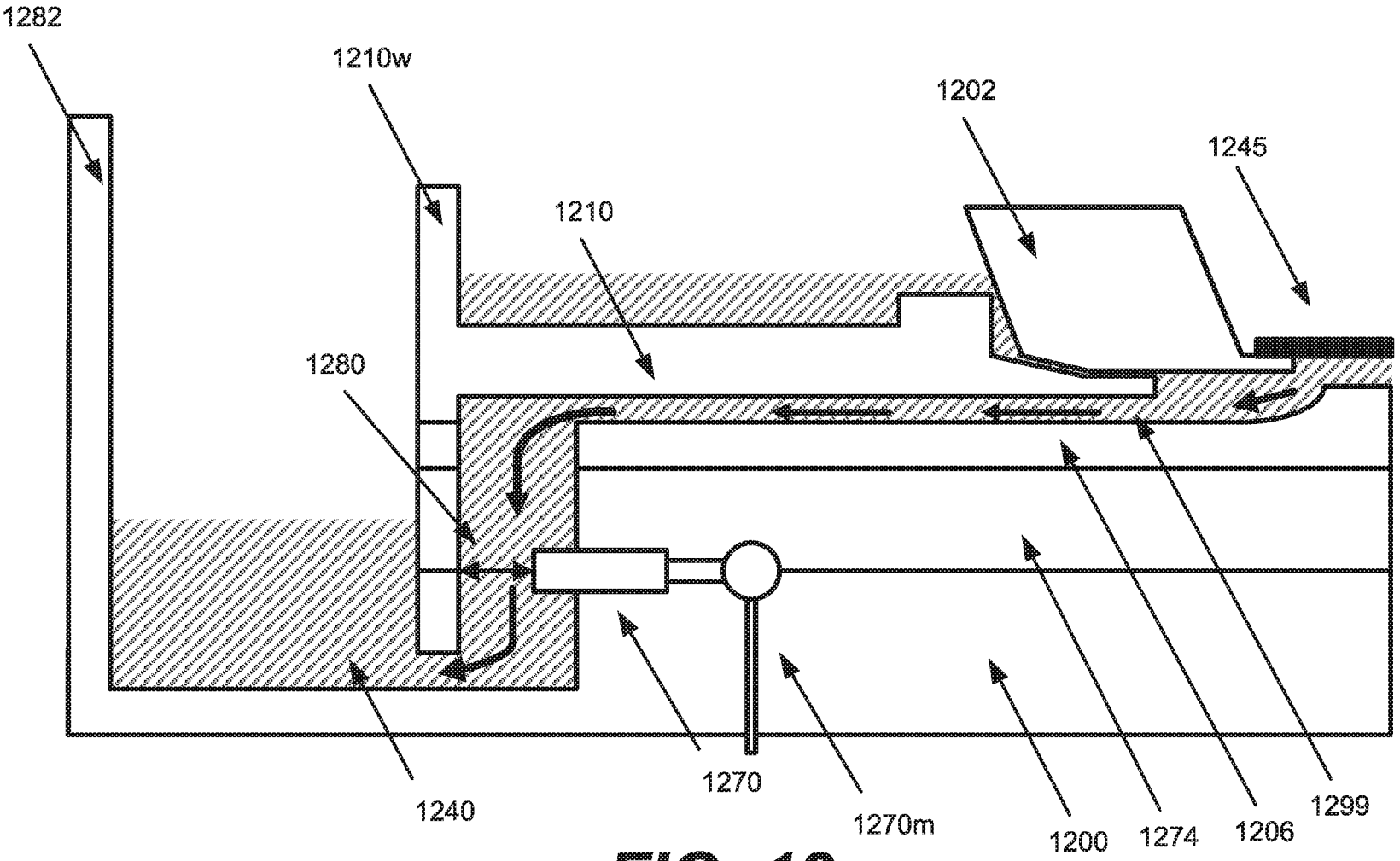
FIG. 12 shows a close-up view of a cross section of a cross flow conduit having a motor-driven variable aperture flow restrictor plate in accordance with certain disclosed embodiments.

Whereas FIG. 11A utilizes a single-size, fixed restrictor plate, FIG. 12 provides another alternative embodiment using a motor-driven variable-aperture restrictor plate 1270. With this embodiment, the restrictor outlet size can be adjusted automatically by an externally controlled stepper motor 1270*m* or pneumatic line. Automatic control of the outlet size allows for real-time adjustment of the fluid containment liquid level, accommodating surges in liquid during wafer/cup entry or large flow rate changes. A variable aperture also enables modulation of the back pressure induced on the plating pump by tuning the outlet size such that it is sufficiently small to maintain solution above the CIRP, yet is not over-restricting. Like FIG. 11A, FIG. 12 includes a plating cell weir wall 1282 of plating cell 1200, a membrane frame 1274, a CIRP 1206, an insert 1210 having a weir 1210*w*, a cup 1202, and a wafer 1245. The opening of the CFC 1280 is modulated by variable-aperture flow restrictor plate 1270 to modulate the flow that eventually exits to the fluid containment unit 1240.

Figure 13:
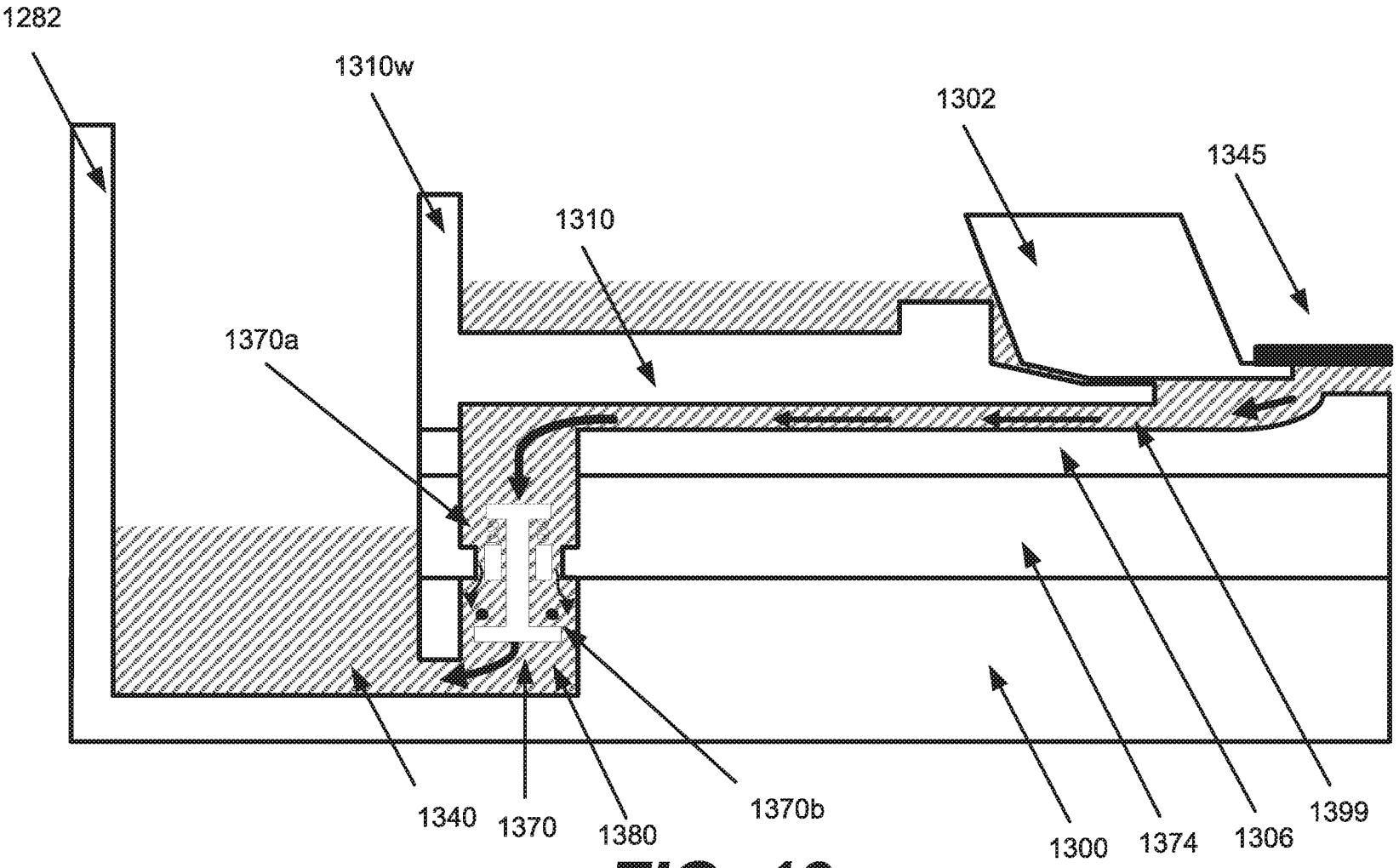
FIG. 13 shows a close-up view of a cross section of a cross flow conduit having a pressure relief valve flow restrictor in accordance with certain disclosed embodiments.

FIG. 13 shows another embodiment involving a pressure relief valve. Like FIGS. 11A and 12, FIG. 13 includes a plating cell 1300 having a plating cell weir wall 1382, a membrane frame 1374, a CIRP 1306, an insert 1310 having a weir 1310*w*, a cup 1302, and a wafer 1345. The opening of the CFC 1380 is modulated by pressure relief valve 1370 which includes a spring 1370*a* and an o-ring 1370*b* to modulate the flow that eventually exits to the fluid containment unit 1340. It will be understood that while a spring embodiment is depicted in FIG. 13, a variety of pressure relief valves may be used. In this embodiment, rather than restricting the CFC 1380 to ensure the weir 1310*w* stays full, a pressure relief "valve" 1370 is implemented to seal off flow when the cup 1302 is not in place. The embodiment includes a stem, spring 1370*a*, o-ring 1370*b* and a series of holes in the membrane frame 1374. When the cup 1302 is not in place, there is no dynamic pressure on the valve 1370 and the spring 1370*a* overcome the static pressure, closing the valve 1370. When the cup 1302 is in place, the dynamic pressure of the fluid overcomes the spring force and opens the valve 1370. The advantage of this embodiment is low restriction when the cup 1302 is in place, and high restriction when the cup 1302 is not in place. A variety of pressure relief valves may be used in various embodiments. For example, a diaphragm may be used in place of a spring for some relief valves.

Figure 14:
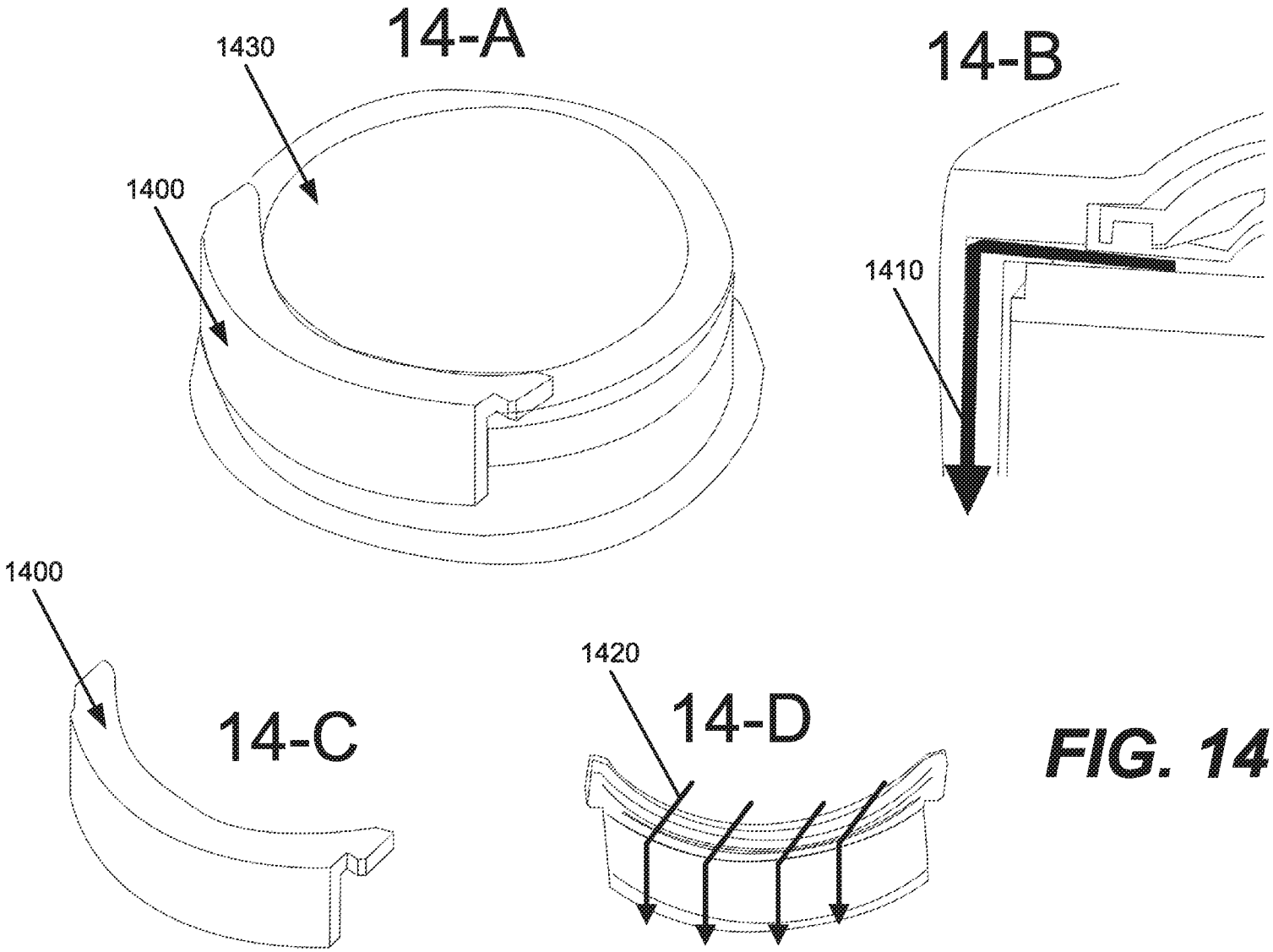
FIG. 14 shows illustrations of an alternative embodiment using an attachable diversion device for diverting flow of fluid downward in tools without a built-in cross flow conduit.

In an alternative embodiment, an attachable diversion device may be used as a retrofit kit for modulating plating cell apparatuses with CIRP, insert, and cell structures that do not have pre-cut channels for forming a cross flow conduit. This device can be made of any chemically compatible polymer (polycarbonate, PET, PPS, PE, PP, PVC, ABS). The size of the opening is approximately the same as that used in the integrated version as described above and can be equipped with similar restrictor plates as the integrated version. FIG. 14 includes example illustrations of an attachable diversion device 1400 as shown in 14-A and 14-B which can be attached (and removable) on the tail end of the plating cell apparatus 1430 at the region of exiting of the cross flow fluid. The device is an attachable piece that can be mounted to the existing plating process kit (requiring minimal hardware changes for implementation). 14-B shows the attachable diversion device 1400 alone. As shown in FIG. 14, this device diverts the plating fluid downward as shown in arrows 1410 in 14-B and arrows 1420 in 14-D, eliminating the risk of splashing over the top of a weir and forming bubbles.

Applications

Certain disclosed embodiments may be suitable for use with a variety of applications. For example, some embodiments may be suitable for use when flowing particular electrolyte chemistries. Examples surfactants that may be in electrolyte chemistries suitable for use in a disclosed embodiment having a cross flow conduit include: poly (ethylene glycol), poly(propylene glycol), pyridinium, or polyethylenimine Additionally, the cross flow conduit apparatuses are particularly suitable for flowing solutions with certain metal complexing agents or ligands such as silver complexing agents. Ethylenediamine tetra acetic acid (EDTA) is one common complexing agent, though many chemical vendors employ proprietary complexing agents for baths containing silver. Disclosed embodiments are also suitable for use with grain refiners such as saccharin, bis-3-sulfopropyl disulfide, or 3-mercaptopropyl sulfonate.

Disclosed apparatuses described herein are suitable for plating apparatuses that are used for plating in through silicon via features, and in through-resist plating applications common to many WLP processes such as formation of pillars, redistribution layers, micropillars, Megapillars, vias, and Damascene processes (for filling nm-scale interconnects and trenches).

Apparatus Controller

In some embodiments, the apparatus includes hardware for accomplishing the process operations and a system controller having instructions for controlling process operations in accordance with the disclosed implementations. The system controller will typically include one or more memory devices and one or more processors configured to execute the instructions so that the apparatus will perform a method in accordance with the disclosed implementations. Machine-readable media containing instructions for controlling process operations in accordance with the disclosed implementations may be coupled to the system controller. Specifically in some embodiments the controller will specify the dwell time, the vertical movement distance of the substrate holder, the maximum vertical acceleration and deceleration of the substrate holder, the rotational speed of the substrate holder, the rotation step angle, the maximum acceleration and deceleration of the substrate holder, the current and/or voltage applied to the substrate (which may or may not be modulated as described herein or otherwise controlled), the relative and absolute timing for moving the substrate holder and altering a current or voltage applied to the substrate, modulating the variable-aperture flow restrictor plate, and/or modulating the flow rate, in any combination. In some embodiments the user provides the desired dwell time and maximum rotation acceleration to the controller, and the controller is programmed to execute the entire method sequence based on these values and values of other parameters stored in the memory. In some other embodiments, the user may additionally specify the desired levels of applied current and/or applied voltage. In a particular example where an applied current or applied voltage is modulated between a higher value and a lower value as the cross flow region is sealed and unsealed, respectively, the controller may be programmed to ensure that the higher current or higher voltage is only applied to the substrate when the cross flow region is sealed. For example, the controller may increase an applied current or applied voltage from a lower value to a higher value only after determining that the substrate holder has reached its lower position and the substrate holder is therefore sealed. Similarly, the controller may decrease an applied current or applied voltage from a higher value to a lower value before the substrate holder begins moving upwards to unseal the cross flow region. This careful timing ensures that the higher current or higher voltage is not applied to the substrate unless the cross flow region is appropriately sealed, thereby ensuring that the limiting current is not exceeded when the cross flow region is unsealed (when the limiting current is relatively lower).

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the delivery of plating fluid, power supply settings, wafer rotation settings, positional and operation settings, wafer transfers into and out of a tool and other transfer tools and/or load locks connected to or interfaced with a specific system.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g., a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

In various embodiments, control over the relevant processing variables/conditions may be achieved using system control software. Such software may control any one or more of the relevant reactor operations. In a particular example, the software control program manipulates the position of the substrate holder (e.g., thereby controlling whether the cross flow region is sealed or unsealed), the current and/or voltage applied to the substrate (which may be modulated between a higher value and a lower value as described herein), and the relative timing for changing the position of the substrate holder and the current or voltage applied to the substrate. In some embodiments, one or more of these reactor operations may be achieved by making the operation of one reactor operation dependent on another reactor operation. This is sometimes referred to as "slaving" one reactor operation or component to another reactor operation or component. For instance, (a) the firmware that controls the position of the substrate holder (sometimes referred to as the lift firmware) and (b) the firmware controlling the power supply can be controlled together in this manner. In one example, the firmware controlling the position of the substrate holder can be dependent on the firmware controlling the power supply such that the substrate holder is only raised or lowered when indicated by the power supply firmware. For instance, the substrate holder may be raised to unseal the cross flow region after the firmware controlling the power supply indicates that it has reached the lower applied current or applied voltage. In another example, the firmware controlling the power supply may be dependent on the firmware controlling the position of the substrate holder such that the power supply ramps current up/down as indicated by the movements of the substrate holder. For instance, the power supply may begin increasing the current or voltage applied to the substrate after the firmware controlling the position of the substrate holder indicates that the substrate holder has reached its lower position and the cross flow region is therefore sealed.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

The apparatus/process described hereinabove may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light with a tool such as a wafer stepper; (4) developing the resist so as to selectively remove resist and thereby pattern it using a tool such as a wet bench; (5) transferring the resist pattern into an underlying film or work piece by using a dry or plasma-assisted etching tool; and (6) removing the resist using a tool such as an RF or microwave plasma resist stripper.

Figure 7:
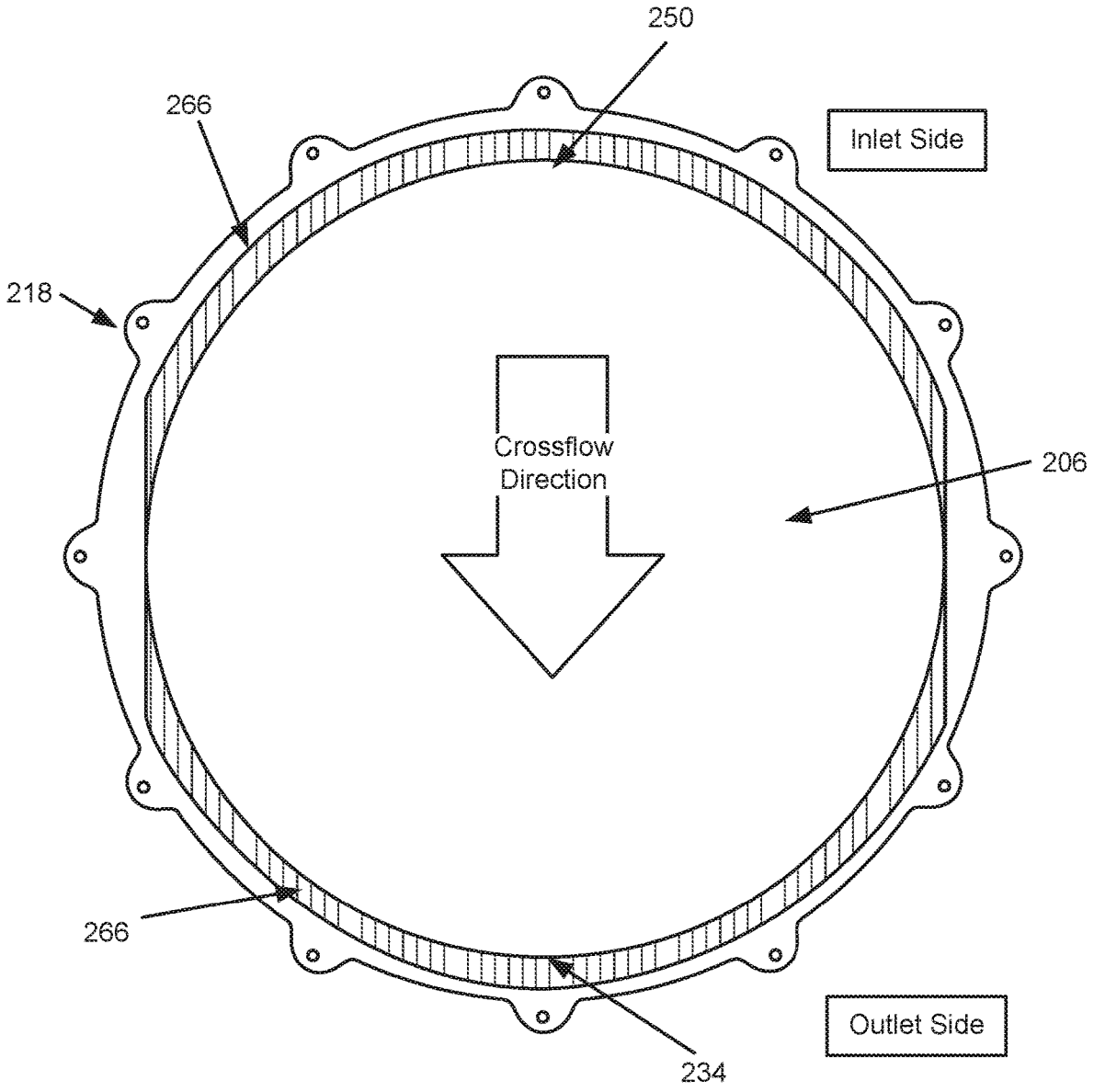
FIG. 7 illustrates a simplified top view of a CIRP and associated hardware showing both the inlet and outlet sides of the cross flow region.

In some embodiments, the apparatus further includes a flow confinement element positioned peripherally in the gap between the CIRP and the substrate holder, and following the circumference of the CIRP. In these embodiments the flow confinement element may form the walls of the cross flow region. In some embodiments the substrate facing surface of the flow confinement element is circular and the element is referred to as a flow confinement ring. When the flow confinement ring is used, the sealing member is configured to seal the outlet between the substrate holder and the substrate-facing surface of the flow confinement ring. Preferably, the sealing member seals at least 75% of the circumference of the ring. In the embodiments illustrated by the drawings, and by the experimental data, the sealing member seals 100% of the circumference of the ring. It is noted that when the flow confinement ring is used, the inlet and outlet for the electrolyte cross flow region are located closer to the ionically resistive element than the substrate-facing surface of the flow confinement ring. In some embodiments, the surface of the flow-confinement ring that is facing the ionically resistive element is shaped such as to provide the outlet for the cross flow of the electrolyte (outlet (e)). An example of a suitable flow-confinement ring is illustrated in FIG. 7. An example of cross flow direction is illustrated in FIG. 1E.

In other embodiments the flow confinement element has a substrate-facing surface that only partially follows the circumference of the ionically resistive element. Such flow confinement element may have a wall partially following the circumference of the ionically resistive element and a vent region comprising one or more gaps, wherein the angle subtended by the vent region is between about 20 to 120 degrees. The gaps of the vent region may serve as the outlet for the cross flow (outlet (e)). Such element is also referred to as a flow diverter, and is described herein. In these embodiments, the sealing member is positioned such as to seal the outlet between the substrate holder and the substrate-facing surface of the flow confinement element.

Modulation of Applied Current or Voltage

During electroplating, current and/or voltage are supplied to the electroplating apparatus in a manner that causes material to deposit on the substrate, which acts as a cathode. Where the electroplating process is controlled by using a controlled current, the relevant current is referred to as an applied current. Where the electroplating process is controlled by using a controlled potential, the relevant potential is referred to as an applied potential or applied voltage. In various embodiments herein, the applied current or applied potential may be modulated during electroplating, for example as the cross flow region is modulated between sealed and unsealed states.

Sealing and unsealing the cross flow region affects the hydrodynamic conditions that affect the electroplating process. For example, where the cross flow region is unsealed, a certain amount of the electrolyte leaks out through the leakage gap between the substrate holder and the cross flow confinement ring. As a result of this leakage, the linear velocity of electrolyte passing over the plating face of the substrate is relatively lower. By comparison, where the cross flow region is sealed, none of the electrolyte (or less of the electrolyte, in cases where the seal is not complete) escapes through the leakage gap, and the linear velocity of electrolyte passing over the plating face of the substrate is relatively higher. As a result, there is relatively less mass transport to the plating face of the substrate when the cross flow region is unsealed, and relatively more mass transport to the plating face of the substrate when the cross flow region is sealed.

The degree of mass transport to the plating face of the substrate has a strong effect on the current or voltage to apply to the substrate. For example, it is often desirable to plate at the highest supportable current or voltage in order to deposit film quickly and thereby maximize throughput. The highest supportable current/voltage are referred to as the limiting current or limiting voltage, respectively. These values are affected by a number of considerations including, e.g., the composition of the electrolyte and the hydrodynamic conditions in the deposition apparatus. When plating occurs at an applied current or voltage that exceeds the limiting current or voltage, there is insufficient metal present in the electrolyte to sustain the applied current or voltage. As a result, unwanted side reactions occur (e.g., hydrogen evolution) and the plating results are quite poor. For instance, a film formed at a current exceeding the limiting current is often porous, includes dendritic growths, and has poor electrical properties (e.g., low conductivity) and mechanical properties (e.g., shear strength).

Because the hydrodynamic conditions are different when the cross flow region is sealed compared to when it is unsealed, the limiting current and limiting voltage are also different between these two states. For example, when the cross flow region is sealed and there is relatively greater mass transport to the plating face of the substrate, the limiting current and limiting voltage are relatively higher. This result arises because a relatively greater degree of metal ions are available at the plating face of the substrate compared to when the cross flow region is unsealed and the mass transport to the plating face of the substrate is relatively lower.

The applied current or voltage is selected to ensure that the limiting current/limiting voltage are not exceeded during any portion of the electroplating process. For instance, in cases where the cross flow region is modulated between sealed and unsealed states and only a single applied current is used throughout the electroplating, the applied current should be selected such that it does not exceed the limiting current when the cross flow region is in the unsealed state. Because the limiting current is higher when the cross flow region is in the sealed state, this also ensures that the applied current will never or rarely exceed the limiting current. One drawback of this approach (e.g., using a single applied current) is that the deposition occurs at a lower applied current than is otherwise supportable while the cross flow region is in the sealed state.

To overcome this limitation and thereby maximize throughput, the applied current or voltage can be modulated along with the cross flow region. In this way, the electroplating apparatus can operate near limiting current or limiting voltage conditions throughout the deposition process, thereby maximizing throughput while achieving high quality film deposition. In various examples, a relatively lower current may be applied to the substrate while the cross flow region is unsealed, and a relatively higher current may be applied to the substrate while the cross flow region is sealed. Similarly, in some examples a relatively lower voltage may be applied to the substrate while the cross flow region is unsealed, and a relatively higher voltage may be applied to the substrate while the cross flow region is sealed.

In certain embodiments, material is electroplated at both the higher and lower levels of applied current or applied voltage. In these or other cases, a small amount or in some cases no more than a negligible amount of material is electroplated onto the substrate when the cross flow region is unsealed and the lower current or voltage is applied to the substrate. In certain embodiments, this means that at least about 70% (in some cases at least about 99%) of the electrodeposited material (by weight) may be deposited on the substrate while the cross flow region is sealed.

Features of an Ionically Resistive Element

Electrical Function

In certain embodiments, the CIRP 206 approximates a nearly constant and uniform current source in the proximity of the substrate (cathode) and, as such, may be referred to as a high resistance virtual anode (HRVA) in some contexts. As noted above, this element may also be referred to as a channeled ionically resistive plate (CIRP) when provided in plate form. Normally, the CIRP 206 is placed in close proximity with respect to the wafer. In contrast, an anode in the same close-proximity to the substrate would be significantly less apt to supply a nearly constant current to the wafer, but would merely support a constant potential plane at the anode metal surface, thereby allowing the current to be greatest where the net resistance from the anode plane to the terminus (e.g., to peripheral contact points on the wafer) is smaller. So while the CIRP 206 has been referred to as a high-resistance virtual anode (HRVA), this does not imply that electrochemically the two are interchangeable. Under the best operational conditions, the CIRP 206 would more closely approximate and perhaps be better described as a virtual uniform current source, with nearly constant current being sourced from across the upper plane of the CIRP 206. While the CIRP is certainly viewable as a "virtual current source", i.e., it is a plane from which the current is emanating, and therefore can be considered a "virtual anode" because it can be viewed as a location or source from which anodic current emanates, it is the relatively high-ionic-resistance of the CIRP 206 (with respect to the electrolyte) that leads the nearly uniform current across its face and to further advantageous, generally superior wafer uniformity when compared to having a metallic anode located at the same physical location. The plate's resistance to ionic current flow increases with increasing specific resistance of electrolyte contained within the various channels of the plate 206 (often but not always having the same or nearly similar resistance of the catholyte), increased plate thickness, and reduced porosity (less fractional cross sectional area for current passage, for example, by having fewer holes of the same diameter, or the same number of holes with smaller diameters, etc.).

Structure

The CIRP 206 contains micro size (typically less than 0.04") through-holes that are spatially and ionically isolated from each other and do not form interconnecting channels within the body of CIRP, in many but not all implementations. Such through-holes are often referred to as non-communicating through-holes. They typically extend in one dimension, often, but not necessarily, normal to the plated surface of the wafer (in some embodiments the non-communicating holes are at an angle with respect to the wafer which is generally parallel to the CIRP front surface). Often the through-holes are parallel to one another. Often the holes are arranged in a square array. Other times the layout is in an offset spiral pattern. These through-holes are distinct from 3-D porous networks, where the channels extend in three dimensions and form interconnecting pore structures, because the through-holes restructure both ionic current flow and fluid flow parallel to the surface therein, and straighten the path of both current and fluid flow towards the wafer surface. However, in certain embodiments, such a porous plate, having an interconnected network of pores, may be used in place of the 1-D channeled element (CIRP). When the distance from the plate's top surface to the wafer is small (e.g., a gap of about 1/10 the size of the wafer radius, for example less than about 5 mm), divergence of both current flow and fluid flow is locally restricted, imparted and aligned with the CIRP channels.

One example CIRP 206 is a disc made of a solid, non-porous dielectric material that is ionically and electrically resistive. The material is also chemically stable in the plating solution of use. In certain cases the CIRP 206 is made of a ceramic material (e.g., aluminum oxide, stannic oxide, titanium oxide, or mixtures of metal oxides) or a plastic material (e.g., polyethylene, polypropylene, polyvinylidene difluoride (PVDF), polytetrafluoroethylene, polysulphone, polyvinyl chloride (PVC), polycarbonate, and the like), having between about 6,000-12,000 non-communicating through-holes. The disc 206, in many embodiments, is substantially coextensive with the wafer (e.g., the CIRP disc 206 has a diameter of about 300 mm when used with a 300 mm wafer) and resides in close proximity to the wafer, e.g., just below the wafer in a wafer-facing-down electroplating apparatus. Preferably, the plated surface of the wafer resides within about 10 mm, more preferably within about 5 mm of the closest CIRP surface. To this end, the top surface of the CIRP 206 may be flat or substantially flat. Often, both the top and bottom surfaces of the CIRP 206 are flat or substantially flat.

Another feature of the CIRP 206 is the diameter or principal dimension of the through-holes and its relation to the distance between the CIRP 206 and the substrate. In certain embodiments, the diameter of each through-hole (or of a majority of through-holes, or the average diameter of the through-holes) is no more than about the distance from the plated wafer surface to the closest surface of the CIRP 206. Thus, in such embodiments, the diameter or principal dimension of the through holes should not exceed about 5 mm, when the CIRP 206 is placed within about 5 mm of the plated wafer surface.

As above, the overall ionic and flow resistance of the plate 206 is dependent on the thickness of the plate and both the overall porosity (fraction of area available for flow through the plate) and the size/diameter of the holes. Plates of lower porosities will have higher impinging flow velocities and ionic resistances. Comparing plates of the same porosity, one having smaller diameter 1-D holes (and therefore a larger number of 1-D holes) will have a more micro-uniform distribution of current on the wafer because there are more individual current sources, which act more as point sources that can spread over the same gap, and will also have a higher total pressure drop (high viscous flow resistance).

In certain cases, however, the ionically resistive plate 206 is porous, as mentioned above. The pores in the plate 206 may not form independent 1-D channels, but may instead form a mesh of through holes which may or may not interconnect. It should be understood that as used herein, the terms channeled ionically resistive plate and channeled ionically resistive element (CIRP) are intended to include this embodiment, unless otherwise noted.

In a number of embodiments, the CIRP 206 may be modified to include (or accommodate) an edge flow element. The edge flow element may be an integral part of the CIRP 206 (e.g., the CIRP and edge flow element together form a monolithic structure), or it may be a replaceable part installed on or near the CIRP 206. The edge flow element promotes a higher degree of cross flow, and hence shear, on the substrate surface, near the edge of the substrate (e.g., near an interface between the substrate and the substrate holder). Without an edge flow element, an area of relatively low cross flow may develop near the interface of the substrate and substrate holder, for example due to the geometry of substrate and substrate holder, and the direction of electrolyte flow. The edge flow element may act to increase cross flow in this area, thereby promoting more uniform plating results across the substrate. Further details related to the edge flow element are presented below.

Distance Between Wafer and CIRP

In certain embodiments, a wafer holder 254 and associated positioning mechanism hold a rotating wafer very close to the parallel upper surface of the CIRP 206. During plating, the substrate is generally positioned such that it is parallel or substantially parallel to the ionically resistive element (e.g., within about 10°). Though the substrate may have certain features thereon, only the generally planar shape of the substrate is considered in determining whether the substrate and ionically resistive element are substantially parallel.

In typical cases, the separation distance is about 0.5-15 millimeters, or about 0.5-10 millimeters, or about 2-8 millimeters. In some cases, the separation distance is about 2 mm or less, for example about 1 mm or less. The separation distance between the wafer and the CIRP 206 corresponds to the height of the cross flow region. As mentioned above, this distance/height may be modulated during an electroplating process to promote a higher degree of mass transfer over the substrate surface.

The small plate to wafer distance can create a plating pattern on the wafer associated with proximity "imaging" of individual holes of the pattern, particularly near the center of wafer rotation. In such circumstances, a pattern of plating rings (in thickness or plated texture) may result near the wafer center. To avoid this phenomenon, in some embodiments, the individual holes in the CIRP 206 (particularly at and near the wafer center) can be constructed to have a particularly small size, for example less than about $1/5^{th}$ the plate to wafer gap. When coupled with wafer rotation, the small pore size allows for time averaging of the flow velocity of impinging fluid coming up as a jet from the plate 206 and reduces or avoids small scale non-uniformities (e.g., those on the order of micrometers). Despite the above precaution, and depending on the properties of the plating bath used (e.g., particular metal deposited, conductivities, and bath additives employed), in some cases deposition may be prone to occur in a micro-non-uniform pattern (e.g., forming center rings) as the time average exposure and proximity-imaging-pattern of varying thickness (for example, in the shape of a "bulls eye" around the wafer center) and corresponding to the individual hole pattern used. This can occur if the finite hole pattern creates an impinging flow pattern that is non-uniform and influences the deposition. In this case, introducing lateral flow across the wafer center, and/or modifying the regular pattern of holes right at and/or near the center, have both been found to largely eliminate any sign of micro-non-uniformities otherwise found there.

Porosity of CIRP

In various embodiments, the CIRP 206 has a sufficiently low porosity and pore size to provide a viscous flow resistance backpressure and high vertical impinging flow rates at normal operating volumetric flow rates. In some cases, about 1-25% of the CIRP206 is open area allowing fluid to reach the wafer surface. In particular embodiments, about 2-5% the plate 206 is open area. In another embodiment, between about 5-25%, or between about 10-25%, or between about 15-25%, or between about 15-20% of the plate 206 is open area. In a specific example, the open area of the plate 206 is about 3.2% and the effective total open cross sectional area is about 23 $cm^2$.

Generally speaking, the CIRP may be more porous in cases where the cross flow region is intermittently sealed, compared to more conventional cases where no such sealing occurs. In conventional cases, CIRP porosity was sometimes limited to about 5% or less. In various embodiments herein where the cross flow region is intermittently (or continuously) sealed, CIRP porosity may be greater, for example a maximum porosity of about 10%, or about 15%, or about 20%, or about 25%. In some such embodiments, the CIRP may have a minimum porosity of about 3%, or about 5%, or about 10%, or about 15%.

Hole Size of Channeled Plate

The porosity of the CIRP 206 can be implemented in many different ways. In various embodiments, it is implemented with many vertical holes of small diameter. In some cases the plate 206 does not consist of individual "drilled" holes, but is created by a sintered plate of continuously porous material. Examples of such sintered plates are described in U.S. Pat. No. 6,964,792, which is herein incorporated by reference in its entirety. In some embodiments, drilled non-communicating holes have a diameter of about 0.01 to 0.05 inches. In some cases, the holes have a diameter of about 0.02 to 0.03 inches. As mentioned above, in various embodiments the holes have a diameter that is at most about 0.2 times the gap distance between the CIRP 206 and the wafer. The holes are generally circular in cross section, but need not be. Further, to ease construction, all holes in the plate 206 may have the same diameter. However this need not be the case, and both the individual size and local density of holes may vary over the plate surface as specific requirements may dictate.

As an example, a solid plate 206 made of a suitable ceramic or plastic material (generally a dielectric insulating and mechanically robust material), having a large number of small holes provided therein, e.g., at least about 1000 or at least about 3000 or at least about 5000 or at least about 6000 (9465 holes of 0.026 inches diameter has been found useful). As mentioned, some designs have about 9000 holes. The porosity of the plate 206 is sometimes less than about 25 percent, or less than about 20 percent, or less than about 5 percent so that the total flow rate necessary to create a high impinging velocity is not too great. Using smaller holes helps to create a large pressure drop across the plate as compared to larger holes, aiding in creating a more uniform upward velocity through the plate.

Generally, the distribution of holes over the CIRP 206 is of uniform density and non-random. In some cases, however, the density of holes may vary, particularly in the radial direction. In a specific embodiment, as described more fully below, there is a greater density and/or diameter of holes in the region of the plate that directs flow toward the center of the rotating substrate. Further, in some embodiments, the holes directing electrolyte at or near the center of the rotating wafer may induce flow at a non-right angle with respect to the wafer surface. Further, the hole patterns in this region may have a random or partially random distribution of non-uniform plating "rings" to address possible interaction between a limited number of holes and the wafer rotation. In some embodiments, the hole density proximate an open segment of a flow diverter or confinement ring 210 is lower than on regions of the CIRP 206 that are farther from the open segment of the attached flow diverter or confinement ring 210.

Protuberances

In certain embodiments, the top face of the CIRP may be modified to increase the maximum deposition rate and improve plating uniformity both over the face of the wafer and within individual plating features. The modification on the top face of the CIRP may take the form of a collection of protuberances.

A protuberance is defined as a structure that is placed/attached on a substrate-facing side of a CIRP that extends into the cross flow region between the CIRP plane and the wafer. The CIRP plane (also referred to as an ionically resistive element plane) is defined as the top surface of the CIRP, excluding any protuberances. The CIRP plane is where the protuberances are attached to the CIRP, and is also where fluid exits the CIRP into the cross flow region.

The protuberances may be oriented in a variety of manners, but in many implementations the protuberances are in the form of long, thin ribs located between columns of holes in the CIRP, and oriented such that the length of the protuberance (i.e., its principal/longest dimension) is perpendicular to the cross flow through the cross flow region. In certain cases, the protuberances may be less than about 1 mm wide. In certain cases, the protuberances have a length to width aspect ratio of at least about 3:1, or at least about 4:1, or at least about 5:1.

In many implementations, the protuberances are oriented such that their length is perpendicular or substantially perpendicular to the direction of cross flow across the face of the wafer (sometimes referred to as the "z" direction herein). In certain cases, the protuberances are oriented at a different angle or set of angles.

A wide variety of protuberance shapes, sizes and layouts may be used. In some embodiments, the protuberances have a face which is substantially normal to the face of the CIRP, while in other implementations the protuberances have a face which is positioned at an angle relative to the face of the CIRP. In yet further implementations, the protuberances may be shaped such that they do not have any flat faces. Some embodiments may employ a variety of protuberance shapes and/or sizes and/or orientations.

Alternative Embodiments of the Ionically Resistive Element

In various embodiments, the ionically resistive element may have properties that differ from those described above. For instance, while much of the foregoing description has referred to the CIRP as a plate, the ionically resistive element can also be provided as a membrane, filter, or other porous structure. Examples of porous structures that may be used as ionically resistive elements include, but are not limited to, ionically resistive membranes and filters, nanoporous cationic membranes, and other porous plates and membranes having appropriate ionic resistivity. Broadly, such ionically resistive elements may shaped, sized, positioned, and have the same or similar properties as described above in relation to a channeled ionically resistive plate. As such, any description provided herein (e.g., in relation to size, porosity, ionic resistivity, materials, etc.) in relation to a CIRP may also apply to a different ionically resistive element used in place of a CIRP.

Such structures may also have certain properties that differ from those described herein with respect to the CIRP. For instance, an ionically resistive membrane used in place of a CIRP may be thinner than a typical CIRP. In certain implementations, a porous structure used in place of a CIRP may be provided on a scaffold or other structure for structural stability. In some embodiments, the ionically resistive element may have through-holes that communicate with one another, while in other cases the through-holes may be non-communicating.

In cases where the cross flow region is defined between the substrate and a supported membrane or sintered element structure (e.g., a supported filter media, a fritted glass or porous ceramic element), the pore sizes of each pore may be less than about 0.01". For non-drilled continuously porous materials of this class, the open area may be larger (e.g., an open area greater than about 30%, with a maximum open area of about 50% or 40% in some embodiments) than the open area in channeled plates made by drilling individual holes in a solid piece of material. Ionically resistive structures made of non-drilled continuously porous materials may utilize a much smaller pore size (e.g., compared to a drilled CIRP) to impart viscous flow resistance to avoid having the electrolyte flow short circuiting through the membrane/element surface. There is a balance between pore size, open area, and net flow resistance to avoid flow-short-circuiting. Higher porosity materials/structures typically utilize smaller pores and/or greater element thickness to achieve this balance.

One example of a suitable material of this class would be a sheet of mechanically strong filter media stretched tight across and supported from below by an open frame network, with an average pore size of less than about 5 um, and a porosity of about 35% or less and 0.001" thick or greater. A few specific examples of appropriate sheet membranes include SelRO nanofiltration MPF-34 membranes, HKF-328 polysulfone ultrafiltration membranes, and MFK-618 0.1 um pore size polysulfone membranes, all supplied by Koch Membrane systems of Willington, Mass. Cationic and anionic membranes can also be used (e.g., Nafion™), as they provide high flow resistance and an ability to conduct ionic electricity across the membranes. In the case where the ionically resistive element is a sintered (fritted) porous glass or ceramic element, the thickness of the element as well as the average and maximum pore size determine the resistance to flow through the ionically resistive element. In general, the resistance to flow through the ionically resistive element (whether implemented as a membrane, filter, sintered/fritted glass element, porous ceramic element, CIRP, etc.) should allow less than about 100 ml/min per $cm^2$ of surface area per inch of static water pressure, more commonly less than about 20 ml/min/$cm^2$/in of water, such as less than about 5 ml/min/$cm^2$/in of water.

Edge Flow Element

In many implementations, electroplating results may be improved through the use of an edge flow element and/or a flow insert. Generally speaking, an edge flow element affects the flow distribution near the periphery of the substrate, proximate the interface between the substrate and substrate holder. In some embodiments, the edge flow element may be integral with a CIRP. In some other embodiments, the edge flow element may be integral with a substrate holder. In yet other embodiments, the edge flow element may be a separate piece that can be installed on a CIRP or substrate holder. The edge flow element may be used to tune the flow distribution near the edge of the substrate, as is desired for a particular application. Advantageously, the flow element promotes a high degree of cross flow near the periphery of the substrate, thereby promoting more uniform (from center to edge of the substrate), high quality electroplating results. An edge flow element is typically positioned, at least partially, radially inside of the inner edge of the substrate holder/the periphery of the substrate. In some cases, an edge flow element may be at least partially positioned at other locations, for example under the substrate holder and/or radially outside of the substrate holder, as described further below. In a number of drawings herein, the edge flow element is referred to as the "flow element."

The edge flow element may be made of various materials. In some cases, the edge flow element may be made of the same material as the CIRP and/or the substrate holder. Generally speaking, it is desirable for the material of the edge flow element to be electrically insulating.

Another method for improving cross flow near the periphery of the substrate is to use a high rate of substrate rotation. However, fast substrate rotation presents its own set of disadvantages, and in various embodiments may be avoided. For example, where the substrate is rotated too quickly, it can prevent formation of an adequate cross flow across the substrate surface. In certain embodiments, therefore, the substrate may be rotated at a rate between about 50-300 RPM, for example between about 100-200 RPM. Similarly, cross flow near the periphery of the substrate can be promoted by using a relatively smaller gap between the CIRP and the substrate. However, smaller CIRP-substrate gaps result in electroplating processes that are more sensitive and have tighter tolerance ranges for process variables.

An edge flow element may be installed to help overcome low convection and low plating rates near the substrate edge. This may also help combat differences that arise due to differing photoresist/feature height.

In certain embodiments, the edge flow element may be shaped such that the cross flow in the cross flow region is directed more favorably into the corner formed by the substrate and substrate holder. A variety of shapes may be used to achieve this purpose.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above described processes may be changed.

The subject matter of the present disclosure includes all novel and nonobvious combinations and sub-combinations of the various processes, systems and configurations, and other features, functions, acts, and/or properties disclosed herein, as well as any and all equivalents thereof.

Additional Examples

A few observations that suggest that improved cross flow through the cross flow region 226 is desirable are presented in this section. Throughout this section, two basic plating cell designs are tested. Both designs contain a confinement ring 210, sometimes referred to as a flow diverter, defining a cross flow region 226 on top of the CIRP 206. Neither design includes an edge flow element, though such an element may be added to either setup, as desired. The first design, sometimes referred to as the control design and/or the TC1 design, does not include a side inlet to this cross flow region 226. Instead, in the control design, all flow into the cross flow region 226 originates below the CIRP 206 and travels up through the holes in the CIRP 206 before impinging on the wafer and flowing across the face of the substrate. The second design, sometimes referred to as the second design and/or the TC2 design, includes a cross flow injection manifold 222 and all associated hardware for injecting fluid directly into the cross flow region 226 without passing through the channels or pores in the CIRP 206 (note that in some cases, however, the flow delivered to the cross flow injection manifold passes through dedicated channels near the periphery of the CIRP 206, such channels being distinct/separate from the channels used to direct fluid from the CIRP manifold 208 to the cross flow region 226).

Other Embodiments

Although the foregoing embodiments have been described in some detail for purposes of clarity of understanding, it will be apparent that certain changes and modifications may be practiced within the scope of the appended claims. It should be noted that there are many alternative ways of implementing the processes, systems, and apparatus of the present embodiments. Accordingly, the present embodiments are to be considered as illustrative and not restrictive, and the embodiments are not to be limited to the details given herein.

What is claimed is:

1. An electroplating apparatus comprising:

an electroplating cell configured to contain an electrolyte and an anode while electroplating metal onto a substrate;

a fluid containment unit having an inlet and configured to receive the electrolyte via the inlet, wherein the inlet comprises an opening in a body of the fluid containment unit, located lower than a fluid level in the fluid containment unit during electroplating;

a substrate holder configured to hold the substrate such that a plating face of the substrate is separated from the anode during electroplating;

a channeled ionically resistive plate including a substrate-facing surface that is separated from the plating face of the substrate by a cross flow region;

a cross flow inlet to the cross flow region for providing electrolyte to the cross flow region; and a cross flow conduit comprising a channel for diverting electrolyte from the cross flow region to the inlet feeding the fluid containment unit of the electroplating cell, the cross flow region being between the cross flow inlet and cross flow conduit, wherein the electroplating apparatus further comprises a membrane frame below the channeled ionically resistive plate, wherein the cross flow conduit further comprises a second channel in the membrane frame for flowing electrolyte from the cross flow region to the inlet to the fluid containment unit of the electroplating cell.

2. The electroplating apparatus of claim 1, wherein the cross flow region is defined at least in part by an upper surface of the channeled ionically resistive plate and a lower surface of the substrate in the substrate holder when in operation, and an insert.

3. The electroplating apparatus of claim 1, wherein the cross flow conduit is disposed to accept electrolyte flowing out of the cross flow region and direct the electrolyte flowing out downward and away from a surface of the substrate.

4. The electroplating apparatus of claim 1, further comprising a flow restrictor for restricting flow of electrolyte in the cross flow conduit.

5. The electroplating apparatus of claim 4, wherein the flow restrictor is one of:

a plate inserted under the channeled ionically resistive plate, a motor-driven variable aperture plate capable of varying an opening size of the cross flow conduit, or a pressure relief valve controlling flow of electrolyte through the cross flow conduit depending on pressure of the electrolyte in response to whether a substrate is present in the electroplating cell.

6. The electroplating apparatus of claim 5, further comprising a controller comprising executable instructions for electroplating material onto the substrate by:

causing flow of electrolyte via cross flow across a surface of the substrate from one side of the substrate to an opposite side of the substrate;

causing diversion of flow of electrolyte to below fluid level as electrolyte flows to the opposite side of the substrate for collection in the fluid containment unit; and causing widening and narrowing of an opening of the cross flow conduit using the motor-driven variable aperture plate in response to flow rate of electrolyte.

7. The electroplating apparatus of claim 1, further comprising a weir wall.

* * * * *